US012655495B2

(12) United States Patent
Azuma et al.

(10) Patent No.: US 12,655,495 B2
(45) Date of Patent: Jun. 16, 2026

(54) STEEL SHEET FOR HOT STAMPING, METHOD FOR MANUFACTURING THE SAME, HOT STAMPED COMPONENT, AND METHOD FOR MANUFACTURING THE SAME

(71) Applicant: NIPPON STEEL CORPORATION, Tokyo (JP)

(72) Inventors: Masafumi Azuma, Tokyo (JP); Yuri Toda, Tokyo (JP); Kenichiro Otsuka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 474 days.

(21) Appl. No.: 18/026,022

(22) PCT Filed: Oct. 15, 2021

(86) PCT No.: PCT/JP2021/038278

§ 371 (c)(1),
(2) Date: Mar. 13, 2023

(87) PCT Pub. No.: WO2022/080489

PCT Pub. Date: Apr. 21, 2022

(65) Prior Publication Data

US 2024/0011113 A1 Jan. 11, 2024

(30) Foreign Application Priority Data

Oct. 16, 2020 (JP) ..... 2020-174457

(51) Int. Cl.

| | |
|---|---|
| ***C21D 9/46*** | (2006.01) |
| ***B21D 22/02*** | (2006.01) |
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(Continued)

(52) U.S. Cl.

CPC ..... *C21D 9/46* (2013.01); *B21D 22/022* (2013.01); *C21D 1/84* (2013.01); *C21D 6/001* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C21D 2211/008; C21D 9/46; C21D 1/18; C21D 1/20; C21D 1/25; C21D 1/673; C21D 1/84; C21D 2211/002; C21D 2211/005; C21D 2211/009; C21D 6/001; C21D 6/002; C21D 6/005; C21D 6/008; C21D 7/13; C21D 8/0205; C21D 8/0226; C21D 8/0236; C21D 8/0263; C21D 8/0273; C21D 8/0278; C21D 2211/004; C22C 38/001; C22C 38/002; C22C 38/005; C22C 38/02; C22C 38/04; C22C 38/06; C22C 38/08; C22C 38/12; C22C 38/14; C22C 38/16; C22C 38/26; C22C 38/28; C22C 38/32; C22C 38/38; C22C 38/004; C22C 38/008; C22C 38/42; C22C 38/44; C22C 38/48; C22C 38/50; C22C 38/54; C22C 38/58; C22C 38/00; C22C 38/18; C22C 38/20; C22C 38/22; C22C 38/24; C22C 38/34; C22C 38/40; C22C 38/46; B21D 22/022

See application file for complete search history.

(56) References Cited

U.S. PATENT DOCUMENTS

2015/0284819 A1* 10/2015 Tamaki ..... C21D 1/673 148/330
2022/0235442 A1* 7/2022 Ono ..... C22C 38/06

FOREIGN PATENT DOCUMENTS

JP 2002-102980 A 4/2002
JP 5407168 B2 2/2014

(Continued)

*Primary Examiner* — Nicholas A Wang
(74) *Attorney, Agent, or Firm* — Birch, Stewart, Kolasch & Birch, LLP

(57) ABSTRACT

A steel sheet for hot stamping includes, as a chemical composition, by mass %: C: 0.060% to 0.120%; Si: 0% to 0.70%; Mn: 1.60% to 3.00%; P: 0.100% or less; S: 0.0100% or less; N: 0.0100% or less; Al: 0.001% to 0.100%; Ti: 0.005% to 0.050%; and B: 0.0005% to 0.0100%. If necessary, the chemical composition contains one or two or more selected from the group consisting of Nb, V, W, Ni, Cu, Mo, Sn, Ca, Mg, and REM and a remainder of Fe and impurities, A microstructure includes 70% or more of upper bainite by area ratio, and a number density of iron carbides having a major axis of 0.01 μm or more included in the upper bainite is equal to or greater than $4/\mu m^2$.

18 Claims, No Drawings

(51) Int. Cl.

| | |
|---|---|
| ***C22C 38/26*** | (2006.01) |
| ***C22C 38/28*** | (2006.01) |
| ***C22C 38/32*** | (2006.01) |
| ***C22C 38/38*** | (2006.01) |

(56) References Cited

FOREIGN PATENT DOCUMENTS

| | | | | |
|---|---|---|---|---|
| JP | 2015-175061 | A | | 10/2015 |
| JP | 2015175061 | | * | 10/2015 |
| JP | WO2020203687 | | * | 10/2020 |
| WO | WO 2014/027682 | A1 | | 2/2014 |

* cited by examiner

STEEL SHEET FOR HOT STAMPING, METHOD FOR MANUFACTURING THE SAME, HOT STAMPED COMPONENT, AND METHOD FOR MANUFACTURING THE SAME

TECHNICAL FIELD OF THE INVENTION

The present invention relates to a steel sheet for hot stamping, a method for manufacturing the same, a hot stamped component, and a method for manufacturing the same.

The present application claims priority based on Japanese Patent Application No. 2020-174457 filed on Oct. 16, 2020, the content of which is incorporated herein by reference.

RELATED ART

In recent years, there has been a demand for further improvement in fuel efficiency of vehicles from the viewpoint of regulations on greenhouse gas emissions associated with global warming. Most vehicle structures are made of steel, especially, steel sheets. Therefore, the steel sheet is thinned to reduced weight, thereby reducing the weight of a vehicle body. As a result, fuel efficiency is improved. However when the thickness of the steel sheet is simply reduced to reduce the weight of the steel sheet, there is concern, that the strength of the structure will be reduced and collision safety will be reduced. Therefore, in order to reduce the thickness of the steel sheet, it is necessary to increase the mechanical strength of the steel sheet used such that the strength of the structure is not reduced. Therefore, in recent years, the application of high strength steel sheets to components for a vehicle has been expanding more and more in order to reduce the weight of the vehicle body and to ensure collision safety.

Similarly, vehicles are being converted into electric vehicles (EVs) from the viewpoint of global warming countermeasures. The EVs are generally much heavier than gasoline vehicles. Therefore, there is a high demand for application of high strength steel sheets. In addition, in recent years, collision regulations have been strengthened. Therefore, for EVs, the application of ultra-high tensile strength steel (steel material having a tensile strength of 980 MPa or more) to collision deformation components has been examined.

For example, Patent Document 1 discloses a method for manufacturing a high strength steel sheet that has a good strength-ductility balance, a good strength-hole expansibility balance, and very high stretch flangeability. Patent Document 1 also discloses that tensile strength is equal to or greater than 980 MPa.

However, in the case of the EVs, some vehicle types are heavy. Therefore, even when ultra-high tensile strength, steel is used, a sheet thickness of 3 mm or more may be required from the viewpoint of rigidity and the like. It is impossible to form the ultra-high tensile strength steel with this thickness using cold press forming.

Therefore, as a method for reducing load during press forming, hot stamping which performs hot forming and die quenching is attracting attention. In the hot stamping, a material to be formed is heated to a high temperature. Then, the material softened by heating is pressed and formed or is cooled at the same time as the formation. That is, the material is heated to a high temperature to be softened. Then, the material is pressed in a softened state. Therefore, it is possible to easily press the material.

However, in Patent Document 1, it is not considered that hot stamping is performed on the cold-rolled steel sheet in the subsequent process.

For example, Patent Document 2 discloses that hot stamping is performed on a steel sheet having a tensile strength of 500 to 600 MPa and a thickness of 1.0 to 1.8 mm to obtain a component having a tensile strength of 1400 MPa or more.

However, in a case in which a steel sheet having a large sheet thickness as described above is formed by hot stamping, in the hot stamping according to the related art as in Patent Document 2, the steel sheet is not sufficiently quenched, and sufficient strength is not obtained in the steel sheet after hot stamping (hot stamped component). In addition, even in the case of a steel sheet having a small sheet thickness, when the thin steel sheet is joined to steel sheets with different sheet thicknesses by tailor welded blank (TWB), it is difficult to manage the clearance of a die and punch in a portion in which the sheet thickness changes, and sufficient quenching may not be performed.

For this reason, the steel sheet to be subjected to hot stamping is required to have sufficient strength after hot stamping even in a case in which a cooling rate is slow during hot stamping.

However, this study has not been conducted in the related art including Patent Document 2.

In addition, in the related art, the hot stamping is mainly applied to a non-deformable portion of a hot stamped component (a component whose, deformation is suppressed to secure the safety of passengers), and the application of the hot stamping to a deformable portion is not considered. That is, as described above, in a case in which the application of the hot stamping to a collision deformation component is considered, characteristics that can suppress cracks at the time of large deformation are required. However, in the hot stamped component according to the related art, the securing, of these characteristics is hardly considered.

PRIOR ART DOCUMENT

Patent Document

[Patent Document 1] Japanese Patent No. 5407168
[Patent Document 2] Japanese Unexamined Patent Application, First Publication No. 2002-102980

DISCLOSURE OF THE INVENTION

Problems to be Solved by the Invention

The invention has been made in view of the above problems. An object of the invention is to provide a steel sheet for hot stamping that has high hardenability during hot stamping (obtains high strength after hot stamping even in a case in which a cooling rate during hot stamping is relatively slow) and good collision characteristics after hot stamping (obtains characteristics that can suppress cracks during large deformation) and a method for manufacturing the same. In addition, an object of the invention is to provide a hot stamped component obtained by using the steel sheet for hot stamping as a material and a method for manufacturing a hot stamped component using the steel sheet for hot stamping.

Means for Solving the Problem

The inventors conducted thorough studies in order to obtain a steel sheet (steel sheet for hot stamping) having high strength and good collision characteristics after hot stamping. As a result, it was found that, when a microstructure of a steel sheet was mainly composed of upper bainite and carbides with a predetermined size were present, the hardenability of the steel sheet was improved, and hot stamping was performed on the steel sheet to obtain a hot stamped component, having high strength and good collision characteristics (had high deformability and was hard to fracture at the time of collision).

The invention has been made based on the above findings and has the following gist.

[1] According to one aspect of the invention, there is provided a steel sheet for hot stamping including, as a chemical composition, by mass %: C: 0.060% to 0.120%; Si: 0% to 0.70%; Mn: 1.60% to 3.00%; P: 0.100% or less; S: 0.0100% or less; N: 0.0100% or less; Al: 0.001% to 0.100%; Ti: 0.005% to 0.050%; B: 0.0005% to 0.0100%; Nb: 0% to 0.100%; V: 0% to 0.100%; W: 0% to 0.100%; Ni: 0% to 2.00%; Cu: 0% to 2.00%; Cr: 0% to 2.00%; Mo: 0% to 2.00%; Sn: 0% to 0.200%; Ca: 0% to 0.0500%; Mg: 0% to 0.0500%; REM: 0% to 0.0500%; and a remainder of Fe and impurities. A microstructure includes 70% or more of upper bainite by area ratio, and a number density of iron carbides having a major axis of 0.1 μm or more included in the upper bainite is equal to or greater than $4/\mu^2$.

[2] In the steel, sheet for hot stamping according to [1], the chemical composition may contain, by mass %, one or more selected from the group consisting of: Nb: 0.005% to 0.100%; V: 0.005% to 0.100%; W: 0.005% to 0.100%; Ni: 0.01% to 2.00%; Cu: 0.01% to 2.00%; Cr: 0.01% to 2.00%; Mo: 0.01% to 2.00%; Sn: 0.005% to 0.200%; Ca: 0.0003% to 0.0500%; Mg: 0.0003% to 0.0500%; and REM: 0.0003% to 0.0500%.

[3] In the steel sheet for hot stamping according to [1] or [2], a tensile strength may be less than 980 MPa.

[4] In the steel sheet for hot stamping according to any one of [1] to [3], the steel sheet for hot stamping may have a plating layer on a surface thereof.

[5] In the steel sheet for hot stamping according to [4], the plating layer may be a hot-dip galvanized layer, a hot-dip galvannealed layer, an electrogalvanized layer, or an Al plating layer.

[6] According to another aspect of the invention, there is provided a method for manufacturing a steel sheet for hot stamping. The method includes: a heating process of heating a steel ingot or a slab having the chemical composition according to [1] to 1,150° C. to 1,300° C. directly or after cooling the steel ingot or the lab; a hot rolling process of performing hot rolling on the steel ingot or the slab after the heating process such that a finishing temperature is equal to or higher than 850° C. to obtain a hot-rolled steel sheet; a coiling process of coiling the hot-rolled steel sheet after the hot rolling process at 640° C. to 450° C.; a holding process of holding the hot-rolled steel sheet after the coiling process in a temperature range of 500° C. to 450° C. for 1.0 hour or longer; and a cooling process of cooling the hot-rolled steel sheet after the holding process to room temperature.

[7] The method for manufacturing a steel sheet for hot stamping according to [6] may further include a cold rolling process of performing cold rolling on the hot-rolled steel sheet after the holding process at a cumulative rolling reduction of 30% to 70% to obtain a cold-rolled steel sheet.

[8] According to still another aspect of the invention, there is provided a method for manufacturing a steel sheet for hot stamping. The method includes: a heating process of heating a steel ingot or a slab having the chemical composition according to [1] to 1,150° C. to 1,300° C. directly or after cooling the steel ingot or the slab; a hot rolling process of performing hot rolling on the steel ingot or the slab after the heating process such that a finishing temperature is equal to or higher than 850° C. to obtain a hot-rolled steel sheet; a coiling process of coiling the hot-rolled steel, sheet after the hot rolling process at 700° C. to 500° C.; a cooling process of cooling the hot-rolled steel sheet after the coiling process to room temperature; a pickling process of pickling the hot-rolled steel sheet after the cooling process; a cold rolling process of performing cold rolling on the hot-rolled steel sheet after the pickling process at a cumulative rolling reduction of 30% to 70% to obtain a cold-rolled steel sheet; an annealing process of heating the cold-rolled steel sheet to an annealing temperature range of 840° C. to 900° C. and holding the cold-rolled steel sheet in the annealing temperature range for 10 to 2,000 seconds; and a heat treatment process of cooling the cold-rolled steel sheet after the annealing process to a temperature range of 400° C. to 600° C., holding the cold-rolled steel sheet in the temperature range for 100 to 1,000 seconds, and cooling the cold-rolled steel sheet to room temperature.

[9] The method for manufacturing a steel sheet for hot stamping according to [8] may further include a plating process of immersing the cold-rolled steel sheet after the heat, treatment process in a plating bath to form a plating layer on a surface of the cold-rolled steel sheet.

[10] The method for manufacturing a steel sheet for hot stamping according to [9] may further include an alloying process of holding the cold-rolled steel sheet after the plating process in an alloying temperature range of 450° C. to 600° C. to alloy the plating layer.

[11] The method for manufacturing a steel sheet for hot stamping according to [8] may further include a plating process of immersing the cold-rolled steel sheet after the annealing process and before the heat treatment process in a plating bath to form a plating layer on a surface of the cold-rolled steel sheet.

[12] The method for manufacturing a steel sheet for hot stamping according to [11] may further include an alloying process of holding the cold-rolled steel sheet after the plating process and before the heat treatment process in an alloying temperature range of 450° C. to 600° C. to alloy the plating layer.

[13] According to yet another aspect of the invention, there is provided a hot stamped component including, as a chemical composition, by mass %: C: 0.060% to 0.120%; Si: 0% to 0.70%; Mn: 1.60% to 3.00%; P: 0.100% or less; 5: 0.0100% or less; N: 0.0100% or less; Al: 0.001% to 0.100%; Ti: 0.005% to 0.050%; B: 0.0005% to 0.0100%; Nb: 0% to 0.100%; V: 0% to 0.100%; W: 0% to 0.100%; Ni: 0% to 2.00%; Cu: 0% to 2.00%; Cr: 0% to 2.00%; Mo: 0% to 2.00%; Sn: 0% to 0.200%; Ca: 0% to 0.0500%; Mg: 0% to 0.0500%; REM: 0% to 0.0500%; and a remainder of Fe and impurities. A microstructure includes 90% or more of tempered martensite by area ratio.

[14] In the hot stamped component according to [13], the chemical composition may contain, by mass %, one or two or more selected from the group consisting of: Nb: 0.005% to 0.100%; V: 0.005% to 0.100%; W: 0.005% to 0.100%; Ni; 0.01% to 2.00%; Cu: 0.01% to 2.00%; Cr: 0.01% to 2.00%; Mo: 0.01% to 2.00%; Sn: 0.005% to 0.200%; Ca: 0.0003% to 0.0500%; Mg: 0.0003% to 0.0500%; and REM: 0.003% to 0.0500%.

[15] According to still yet another aspect of the invention, there is provided a method for manufacturing a hot stamped component. The method includes a hot stamping process of heating the steel sheet for hot stamping according to any one of [1] to [5] using a heating furnace at an ambient temperature of 850° C. to 950° C. for 3 minutes or longer and cooling the steel sheet for hot stamping to a martensitic transformation start temperature or lower at a cooling rate of 10° C./sec or faster.

[16] In the method for manufacturing a hot stamped component according to [15], the cooling rate in the hot stamping process may be 10 to 20° C./sec.

Effects of the Invention

According to the present invention, it is possible to provide a steel sheet for hot stamping which has high hardenability during hot stamping and good collision characteristics after hot stamping, a method for manufacturing the same, a hot stamped component using the steel sheet for hot stamping, and a method for manufacturing the same.

EMBODIMENTS OF THE INVENTION

A steel sheet for hot stamping according to an embodiment of the invention (hereinafter, referred to as a steel sheet according to this embodiment), a method for manufacturing the same, a hot stamped component obtained by performing hot stamping on the steel sheet according to this embodiment (a hot stamped component according to this embodiment), and a method for manufacturing a hot stamped component using the steel sheet according to this embodiment will be described.

First, the steel sheet according to this embodiment will be described. The steel sheet according to this embodiment has a predetermined chemical composition. A microstructure includes 70% or more of upper bainite by area ratio, and the number density of iron carbides having a major axis of 0.1 μm or more included in the upper bainite is equal to or greater than 4/μm$^2$.

<Microstructure>

[Microstructure Includes 70% or More of Upper Bainite by Area Ratio]

[Number Density of Iron carbides Having Major Axis of 0.1 μm or More Included in Upper Bainite Is Equal to or Greater Than 4/μm$^2$]

In general, steel sheets for hot stamping are designed to be easily processed by, for example, cutting, and to have high strength after hot stamping. Therefore, in many cases, the microstructure of the steel sheet for hot stamping (before hot stamping) is a structure including a large amount of soft ferrite (for example, a ferrite-pearlite structure). On the other hand, in a case in which a large amount of alloying element is added to increase hardenability during hot stamping heat treatment, the strength of the steel sheet for hot stamping also increases, causing problems such as poor cuttability and difficulty in correction with a leveler. Further, the addition of a large amount of alloying element enhances the hardenability of the steel sheet and lowers a Ms point. Therefore, the microstructure of a hot-stamping formed body is mainly composed of fresh martensite (martensite without including carbide). In this case, deformability at the time of collision is degraded.

In contrast, the inventors found that a configuration in which the area ratio of upper bainite in a microstructure of a steel sheet for hot stamping was equal to or greater than 70% and the number density of iron carbides having a major axis of 0.1 μm or more included in the upper bainite was equal to or greater than 4/μm$^2$ made it possible to achieve both hardenability for obtaining sufficient strength after hot stamping and collision characteristics after hot stamping while suppressing the hardness of the steel sheet for hot stamping in order to secure workability including cutting even in a case in which a large amount of alloying element was included.

In some cases, the microstructure includes, for example, ferrite, pearlite, and martensite in addition to the upper bainite. When the area ratio of the upper bainite is less than 70% and the total area ratio of the ferrite and the pearlite is greater than 30%, it is not possible to obtain good collision characteristics after hot stamping (VDA bendability, which will be described below, is reduced), and it is impossible to suppress fracture at the time of collision. On the other hand, when the area ratio of the upper bainite is less than 70% and the area ratio of the martensite is greater than 30%, the strength of the steel sheet for hot stamping is too high, and workability is degraded. Therefore, the area ratio of the upper bainite is set to 70% or more.

The reason why the number density of iron carbides having a major axis of 0.1 μm or more is equal to or greater than 4 μm$^2$ is to uniformly disperse the carbides, to promote the dissolution of the carbides at the time of hot stamping, to increase hardenability, and to improve bendability at the time of collision. The carbide included in the upper bainite has a needle-like shape, is present between the laths of the upper bainite, and has a shape elongated in one direction. In this embodiment, the major axis is defined as the size of the iron carbide.

In a case in which the number density of iron carbides having a size equal to or greater than 0.1 μm is less than 4/μm$^2$, assuming the chemical composition and microstructure of the steel sheet according to this embodiment (the area % of the upper bainite is equal to or greater than 70%), a large amount of iron carbide having a size less than 0.1 μm is precipitated, or the iron carbide is excessively coarsened. In a case in which a large amount of iron carbide having a major axis of less than 0.1 μm is precipitated, the strength of the steel sheet is excessively increased due to precipitation hardening, and workability is reduced. In addition, excessively large carbides are not dissolved at the time of hot stamping to reduce hardenability or to serve as the origin of crack formation at the time of collision deformation. Therefore, the number, density of the iron carbides having a size equal to or greater than 0.1 μm is set to 4/μm$^2$ or more. It is preferable that the size of the carbide is 0.1 to 0.5 μm. Further, the setting of the size of the carbide to 0.1 to 0.5 μm also contributes to setting the strength of the steel sheet for hot stamping to 980 MPa or less. Furthermore, the setting of the size of the carbide to the above range also contributes to increasing the area ratio of tempered martensite in the hot-stamping formed body (hot stamped component), whose detailed mechanism is unknown.

The area ratio of the microstructure and the number density of the iron carbides in the upper bainite can be measured by the following method.

First, a steel sheet is cut in parallel to a rolling direction and is then polished and etched with a vital reagent such that a sheet thickness direction is an observed section. Then, a ¼ position of the sheet thickness from a surface in the sheet thickness direction (a range of ⅛ to ⅜ of the sheet thickness from the surface is allowed) can be observed at a magnification of 1,000 to 30,000 using a scanning electron microscope (SEM) to identify ferrite, upper bainite, lower bainite, pearlite, and marten site.

At the time of the identification, it is possible to determine the structure from microstructural morphology: ferrite is an equiaxed grain without including iron carbides; pearlite is a layered structure of ferrite and cementite; upper bainite is a lath-shaped structure including cementite and residual austenite between laths: and lower bainite includes carbides in a lath. The area ratio of each structure identified from a SEM observation image is measured.

Martensite includes both tempered martensite that includes carbides in laths and as-quenched martensite (fresh martensite) without including cubicles, which can be identified by being observed by a SEM or a transmission electron microscope (TEM) to check whether carbides are present or absent. For example, 10 visual fields of a range (visual field) of 30 μm×25 μm are observed at a magnification of 3,000, and the average value thereof is used as the area ratio.

Carbides in the upper bainite can also be quantified by the above observation. However, since the carbides in the upper bainite are fine and are on the order of 0.1 μm, it is desirable to observe the carbides with a high-resolution field emission (FE)-SEM. For example, 20 visual fields of a range (visual field) of 10 μm×8 μm are observed at a magnification of 10,000, and the average value thereof is used as the number density.

The reason why the ¼ position of the sheet thickness from the surface in the sheet thickness direction is measured is that, in general, a structure at this position is the most representative structure of the steel sheet. In the steel sheet according to this embodiment, the structure is generally uniform in the sheet thickness direction. Therefore, the same structure is obtained even when measurement is performed at other positions.

In the steel sheet according to this embodiment, the microstructure is controlled as described above, and the chemical composition is controlled as described below such that the microstructure of a component after hot stamping (hot stamped component) can include 90% or more of tempered martensite in a wide range in which a cooling rate during hot stamping is equal to or faster than 10° C./sec. As a result, sufficient strength is obtained. In particular, hardenability at a cooling rate of 10 to 30° C./sec, which has been a problem with the steel sheet for hot stamping according to the related art, is greatly improved. Therefore, it is possible to obtain high strength after hot stamping not only in a case in which the sheet thickness of the steel sheet for hot stamping is small but also, in a case in which the sheet thickness is relatively large (for example, about 3 to 6 mm).

<Chemical Composition>

Next, the chemical composition of the steel sheet according to this embodiment will be described. Hereinafter, % related to the chemical composition means mass %.

C: 0.060% to 0.120%

C is an element that increases the strength of the steel sheet and controls martensitic transformation start temperature during cooling in a hot stamping process to contribute to the improvement of VDA bendability. When a C content is less than 0.060%, it is not possible to secure a tensile strength (maximum tensile strength) of 980 MPa or more after hot stamping. Therefore, the C content is set to 0.060% or more. It is preferable that the C content is equal to or greater than 0.070%.

On the other hand, when, the C content is greater than 0.120%, the martensitic transformation start temperature is too high, and it is not possible to obtain a sufficient area ratio of tempered martensite in the hot stamping process. In this case, the suppression of fracture at the time of collision is not sufficient in the steel sheet after hot stamping (hot stamped, component). Therefore, the C content is set to 0.120% less. It is preferable that the C content is equal, to or less than 0.110%.

Si: 0% to 0.70%

Si is an, element that increases an Ae3 point and increases the heating temperature required to obtain tempered markensite as a primary phase after hot stamping. Therefore, when a Si content is excessively large productivity and economy are degraded. For this reason, the Si content is set to 0.70% or less.

On the other hand, the Si content may be 0%. However, Si is an element that increases the strength of the steel sheet. In addition, for a non-plated steel sheet, Si is an element that improves scale adhesion. Therefore, Si may be contained. In a case in which this effect is obtained, it is preferable that the Si content is equal to or greater than 0.05%.

Mn: 1.60% to 3.00%

Mn is an element that increases the hardenability of the steel sheet. A Mn content is set to 1.60% or more in order to delay ferritic transformation in a cooling process during hot stamping and to change the microstructure of the hot-stamping formed body such that a tempered martensite is primary phase at a cooling rate of 10° C./sec or faster.

On the other hand, when the Mn content is greater than 3.00%, not only the effect is saturated, but also the steel sheet is embrittled or is cracked during casting, cold rolling, or hot rolling. Therefore, the Mn content is set, to 3.00% or less.

P: 0.100% or Less

P is an element that is segregated in a thickness middle portion of the steel sheet and also embrittles a welded part. When a P content is greater than 0.100%, the welded part is significantly embrittled. Therefore, the P content is set to 0.100% or less. It is preferable that the P content is equal to or less than 0.050%. The lower limit of the P content is not particularly defined and may be 0%. However, reducing the P content to less than 0.001% is economically disadvantageous. Therefore, the P content may be set to 0.001% or more.

S: 0.0100% or Less

S is an element that is present as an inclusion, such as MnS, and degrades collision characteristics. Therefore, it is desirable to reduce a S content. When the S content is greater than 0.0100%, the collision characteristics are significantly degraded. Therefore, the S content is set to 0.0100% or less. The lower limit of the S content is not particularly defined and may be 0%. However, reducing the S content to less than 0.0001% is economically disadvantageous. Therefore, the S content may be set to 0.0001% or more.

N: 0.0100% or Less

N is an element that forms coarse nitride, serves as the origin of cracks at the time of collision, and degrades collision characteristics. When, a N content is greater than 0.0100%, the collision characteristics are remarkably degraded. Therefore, the N content is set to 0.0100% or less. The lower limit of the N content does not need to be particularly defined and may be 0%. However, when the N content is reduced to less than 0.0001%, a manufacturing cost increases significantly. Therefore, the N content may be set to 0,0001% or more or may be set to 0.0005% or more.

Al: 0.001% to 0.100%

Al is an element that acts as a deoxidizer. When an Al content is less than 0.001%, it is not possible to obtain a sufficient deoxidation effect, and a large amount of inclusions (oxides) is present in the steel sheet. These inclusions are not preferable because they become the origin of cracks at the time of collision and cause fracture. Therefore, the Al content is set to 0.001% or more.

On the other hand, when the Al content is greater than 0.100%, the Ae3 point increases, and the heating temperature during hot stamping needs to be increased, which is not preferable. Therefore, the Al content is set to 0.100% or less.

Ti: 0.005% to 0.050%

Ti is an element that is combined with N to form IN, prevents B from becoming nitride, and improves hardenability. In order to obtain this effect, a Ti content is set to 0.005% or more. It, is preferable that the Ti content is equal to or greater than 0.007%.

On the other hand, when the Ti content is greater than 0.050% the amount of C that contributes to strengthening of martensite is reduced by the formation of Ti carbides, and the strength of the steel sheet (hot stamped component) after hot stamping is not sufficiently obtained. Therefore, the Ti content is set to 0.050% or less. It is preferable that the Ti content is equal to or less than 0.040%.

B: 0.0005% to 0.0100%

B is an effective element for increasing the hardenability of the steel sheet and changing the primary phase of the microstructure of the steel sheet after hot stamping (hot stamped component) to tempered martensite. Since this effect becomes remarkable at a B content of 0.0005% or more, the B content is set to 0.0005% or more.

On the other hand, when the B content is greater than 0.0100%, the effect is saturated. In addition, iron-based borides are precipitated, and the effect of improving hardenability by B is reduced. Therefore the B content, is set to 0.0100% or less. The B content is preferably equal to or less than 0.0080% and more preferably equal to or less than 0.0050%.

In the steel sheet according to this embodiment, the remainder of the above-described elements may be Fe and impurities. The impurities are elements that can be mixed, for example, in a steel sheet manufacturing process and are allowed within a range that does not have a clear adverse effect on the steel sheet according to this embodiment. The impurities include, for example, P and S which have been described above and O. When O is contained, it forms oxide and is often present as an inclusion.

On the other hand, the steel sheet according to this embodiment may further contain the following elements, if necessary.

Ni: 0% to 2.00%

Cu: 0% to 2.00%

Cr: 0% to 2.00%

Mo: 0% to 200%

Ni, Cu, Cr, and Mo are elements that increase the hardenability of the steel sheet and change the primary phase of the microstructure of the steel sheet after hot stamping to tempered martensite to contribute to increasing strength. This effect becomes remarkable by containing 0.01% or more of one or more of Ni, Cu, Cr, and Mo. Therefore, it is preferable that the total content of these elements or the content of each element is equal to or greater than 0.01% in order to obtain the above effect.

On the other hand, when the amount of each element, is excessive, weldability, hot workability, and the like are degraded, or the strength of the steel, sheet for hot stamping is too high, causing manufacturing troubles. Therefore, in a case in which these elements are contained, the content of each of Ni, Cu, Cr, and Mo is set to 2.00% or less.

Nb: 0% to 0.100%

V: 0% to 0.100%

W: 0% to 0.100%

Nb, V, and W are elements that suppress the growth of austenite during hot stamping and contribute to increasing the strength and toughness of the hot stamped component by grain refinement strengthening. This effect becomes remarkable by containing 0.005% or more of one or two or more of Nb, V, and W. Therefore, it is preferable that the total content of these elements or the content of each element is equal to or greater 0.005% in order to obtain the above effect.

On the other hand, when the content of each element is greater than 0.100%, the amount of C, which contributes to martensite strengthening, is reduced by the formation of carbides of Nb, V, and W. and the strength is reduced, Therefore, when these elements are contained, the content of each of Nb, V, and W is set to 0,100% or less. It is preferable that the content is equal to or less than 0.090%.

REM: 0% to 0.0500%

Ca: 0% to 0.0500%

Mg: 0% to 0.0500%

REM, Ca, and Mg are elements that contribute to improving the strength and quality of the steel sheet. When the sum of one or two or more of REM, Ca and Mg is less than 0.0003%, a sufficient effect is not obtained. Therefore, when the above effect is obtained, it is preferable that the total content of REM Ca, and Mg is equal to or greater than 0.0003%.

On the other hand, when the total content of one or two or more of REM, Ca, and Mg is greater than 0.0500%, castability and hot workability are degraded. Therefore, when these elements are contained, the content of these elements is set to 0.0500% or less.

REM is an abbreviation of Rare Earth Metal and refers to an element belonging to Sc, Y, and lanthanoid series. In many cases, La and Ce are added as REM and are added as misch metal. However, in addition to La and Ce, lanthanoid series elements may be contained in combination, or metal may be added. In this case, the effect is also exhibited.

Sn: 0% to 0.200%

Sn is an element that improves corrosion resistance. This effect becomes remarkable at a Sn content of 0.005% or more. Therefore, it is preferable that the Sn content is equal to or greater than 0.005% in a case in which this effect is obtained.

On the other hand, when the Sn content is greater than 0.200%, a slab is embrittled, causing cracks during casting and cracks on a surface of a hot-rolled steel sheet. Therefore, when Sn is contained, the Sn content is set to 0.200% or less.

The above-mentioned chemical composition may be measured by a general analytical method. For example, the chemical composition may be measured using inductively coupled plasma-atomic emission spectrometry (ICP-AES). C and S may be measured using a combustion-infrared absorption method, and N may be measured using an inert gas fusion-thermal conductivity method.

The steel sheet according to this embodiment may have a plating layer on its surface. The plating layer is preferable because it prevents the generation of scale during hot stamping and improves corrosion resistance.

The plating layer is not limited and is, for example, a hot-dip galvanized layer, a hot-dip galvannealed layer, an electrogalvanized layer, or an Al plating layer. These layers may be formed according to the purpose.

<Mechanical Characteristics and Sheet Thickness>

Tensile strength (TS): preferably less than 980 MPa

It is preferable that the steel sheet for hot stamping is easily processed during processing, such as cutting, and has high strength after hot stamping. Therefore, for example, when the tensile strength is equal to or greater than 980 MPa, the wear of a blade of a shear becomes severe, or it is difficult, to correct a sheet shape. As a result, advantages, such as ease of cutting and ease of shape correction, which are one of the purposes of applying hot stamping, are lost. Therefore, the above range of the tensile strength is not preferable. Therefore, it is preferable that the tensile strength of the steel sheet according to this embodiment is less than 980 MPa.

The tensile strength of the steel sheet is measured by collecting a JIS No. 5 tensile test piece from the steel sheet such that a direction perpendicular to the rolling direction is the tensile direction and performing a tensile test according to JIS Z 2241:2011.

The sheet thickness of the steel sheet according to this embodiment, is not limited. For example, the sheet thickness is 1.0 to 6.0 mm. However, the sheet thickness at which the effect of the steel sheet according to this embodiment becomes remarkable is equal to or greater than 3.0 mm. However, even for a thin steel sheet with a thickness of 1.0 to 3.0 mm, it is possible to obtain stable hardness even under the condition that the clearance of a die and punch is large and the cooling rate is slow. Therefore, even when the steel sheet is used for the purpose with a small sheet thickness, it is possible to obtain the effect.

The steel sheet according to this embodiment has high hardenability during hot stamping and has good collision characteristics after hot stamping. Therefore, for example, in a case in which hot stamping that heats a steel sheet for 3 minutes or more using a heating furnace with an ambient temperature of 850° C. to 950° C. and then cools the steel sheet to the martensite transformation start temperature or less at a cooling rate in a wide range of 10° C./sec or more, which includes a slow cooling rate of 20° C./sec or less, is performed, a tensile strength of 980 MPa or more and good collision characteristics where a VDA maximum bending angle is equal to or greater than 80° in a case in which a VDA bending test, which will be described below, is performed are obtained.

<Manufacturing Method>

The steel sheet according to this embodiment can be manufactured by a manufacturing method described in the following <1> or <2>.

<1>

A manufacturing method includes: a heating process of, heating a steel ingot or a slab having a predetermined chemical composition to 1,150° C. to 1,300° C. directly or after cooling the steel ingot or the slab; a hot rolling process of performing hot rolling on the steel ingot or the slab after the heating process such that a finishing temperature is equal to or higher than 850° C. to obtain a hot-rolled steel sheet; a coiling process of coiling the hot-rolled steel sheet after the hot rolling process at 640° C. to 450° C.; a holding process of holding the hot-rolled steel sheet after the coiling process in a temperature range of 500° C. to 450° C. for 1.0 hour or longer; and a cooling process of cooling the hot-rolled steel sheet after the holding process to room temperature.

<2>

A manufacturing method includes: a heating process of heating a steel ingot or a slab having a predetermined chemical composition to 1,150° C. to 1,300° C. directly or after cooling the steel ingot or the slab; a hot rolling process of performing hot rolling on the steel ingot or the slab after the heating process such that a finishing temperature is equal to or higher than 850° C. to obtain a hot-rolled steel sheet; a coiling process of coiling the hot-rolled steel sheet after the hot rolling process at 700° C. to 500° C.; a cooling process of cooling the hot-rolled steel sheet after the coiling process to room temperature; a pickling process of pickling the hot-rolled steel sheet after the cooling process; a cold rolling process of performing cold rolling on the hot-rolled steel sheet after the pickling process at a cumulative rolling reduction of 30% to 70% to obtain a cold-rolled steel sheet; an annealing process of heating the cold-rolled steel sheet to an annealing temperature range of 840° C. to 900° C. and holding the cold-rolled steel sheet in the annealing temperature range for 10 to 2,000 seconds; and a heat treatment process of cooling the cold-rolled steel sheet after the annealing process to a temperature range of 400° C. to 600° C., holding the cold-rolled steel sheet in the temperature range for 100 to 1,000 seconds, and cooling the cold-rolled steel sheet to room temperature.

Hereinafter, preferred conditions of each process will be described. Since the preferred conditions up to the hot rolling process are common to the manufacturing methods according to <1> and <2>, they will be collectively described. Since preferable condition ranges for proceeding to the coiling process are different, they will be described for <1> and <2>. Well-known conditions can be adopted as the conditions that are not described below.

[Heating Process] Common to <1> and <2>

In the heating process, a steel ingot or a slab which has been manufactured by casting and has the same chemical composition as the steel sheet according to this embodiment is heated before hot rolling. As the slab to be subjected to hot rolling, a continuous cast slab or a slab manufactured by a thin slab, caster or the like can be used. In addition, after casting, the slab may be heated after the temperature is reduced to around room temperature or may be reheated while the temperature is being reduced.

The heating temperature of the steel ingot or the slab is set to 1,150° C. to 1,300° C. When the heating temperature is lower than 1,150° C., the finishing rolling temperature is reduced in the subsequent hot rolling process, causing an increase in the load on a rolling mill. In this case, it is difficult to perform rolling, or a defect in the shape of the steel sheet after rolling may occur. On the other hand, when the heating temperature is higher than 1,300° C., the cost increase, and cracks and the like occur in the surface. In this case, the collision characteristics of the steel sheet after hot stamping (hot stamped component) are degraded.

[Hot Rolling Process] Common to <1> and <2>

In the hot rolling process, the heated steel ingot or slab is rolled such that the finishing rolling temperature (finishing rolling final pass exit side temperature) is equal to or higher than 850° C. to obtain a hot-rolled steel sheet. When the finishing rolling temperature is lower than 850° C., rolling force increases, it is difficult to perform rolling, or a defect in the shape of the steel sheet after rolling occurs. The upper limit of the finishing rolling temperature does not need to be particularly defined. However, when the finishing rolling temperature is excessively high, the heating temperature in the heating process needs to be excessively high in order to ensure the finishing rolling temperature. Therefore, it is preferable that the finishing rolling temperature is equal to or lower than 1,000° C.

Hereinafter, the processes after the coiling process in the manufacturing method according to <1> will be described.

[Coiling Process] <1>

In the coiling process, the hot-rolled steel sheet after the hot rolling process is coiled at 640° C. to 450° C.

When the coiling temperature is higher than 640° C., the structure of ferrite, pearlite, or the like is formed. In the microstructure of the hot-rolled steel sheet, it is impossible for the area ratio of upper bainite to be equal to or greater than 70%. In addition, carbides present in the upper bainite become coarse, and the number density of iron carbides is not sufficiently obtained. The coarse carbides are difficult to dissolve even during heating at the time of hot stamping and cause a reduction in hardenability. In addition, undissolved coarse carbides become the origin of cracks, which causes the degradation of collision characteristics after hot stamping. Therefore, the coiling temperature is set to 640° C. or lower.

On the other hand, when the coiling temperature is lower than 450° C., the structure of the steel sheet becomes a structure mainly composed of martensite, and the strength is too high. As a result, workability is reduced. Therefore, the coiling temperature is set to 450° C. or higher.

[Holding Process]<1>

In the holding process, the hot-rolled steel sheet after the coiling process is held in, a temperature range of 500° C. to 450° C. for 1.0 hour or longer. This holding causes the area ratio of the upper bainite of the microstructure to be equal to or greater than 70% and causes iron carbides having a major axis of 0.1 μm or more to be precipitated in the upper bainite at a number density of $4/\mu m^2$ or more.

When the holding temperature is higher than 500° C., the carbides in the upper bainite are coarsened, which makes it impossible for the number density of iron carbides having a major axis of 0.1 μm or more to be equal to or greater than $4/\mu m^2$.

On the other hand, when the holding temperature is lower than 450° C., a large amount, of carbides having a major axis of less than 0.1 μm is precipitated, and the strength of the steel sheet is excessively increased by strengthening. In addition, it is impossible for the number density of the iron carbides having a major axis of 0.1 μm or more to be equal to or greater than $4/\mu m^2$.

Further, even when the holding time (retention time) in the temperature range of 500° C. to 450° C. is shorter than 1.0 hour, it is impossible for the number density of the iron carbides having a major axis of 0.1 μm or more to be equal to or greater than $4/\mu m^2$.

The holding temperature does not need to be constant and may change within the temperature range of 500° C. to 450° C. In addition, when the steel sheet is left after normal coiling, it is difficult, to hold the steel sheet at 500° C. to 450° C. for 1.0 hour or longer. Therefore, the steel sheet may be held for 1.0 hour or longer by keeping warm or heating.

Assuming the manufacturing method according to <1>, it is difficult to substitute a box annealing furnace (BAP) for the holding process. The steel sheet according to this embodiment has high hardenability. Therefore, when the steel sheet is cooled without being held, it is likely to be changed to a structure mainly composed of martensite. Therefore, even when the steel sheet is cooled and then subjected to heat treatment by BAF or the like in a post-process, it is changed to a structure mainly composed of tempered martensite, and it is difficult for the area, ratio of the upper bainite to be equal to or greater than 70%. In addition, in some cases, coarse carbides are precipitated by BAF, and hardenability during, hot stamping deteriorates.

[Cooling Process]<1>

In the cooling process, the hot-rolled steel sheet after the holding process is cooled to room temperature. Cooling conditions are not particularly limited.

[Pickling Process]<1>

After the cooling process, pickling may be performed to remove scales generated on the surface of the steel sheet. Any pickling method may be used as long as it can remove the scales. In addition, hydrochloric acid, sulfuric acid, nitric acid, hydrofluoric acid, or a mixture thereof may be used for the pickling. Further, an inhibitor may be added to suppress the dissolution of base metal. Moreover, the pickling may be performed or may be performed a plurality of times.

[Cold Rolling Process]<1>

Cold rolling may be further performed on the hot-rolled steel sheet after the pickling process to obtain a cold-rolled steel sheet. In a case in which the cold rolling is performed, when the cumulative rolling, reduction is less than 30%, it is difficult to keep the shape of the steel sheet flat, and the ductility of the final product is degraded. On the other hand, when the cumulative rolling reduction is greater than 70%, the rolling force becomes too high, which makes it difficult to perform cold rolling. Therefore, it is preferable that the cumulative rolling reduction is 30% to 70%. It is more preferable that the cumulative rolling reduction is 40% to 70%.

The number of rolling passes and the rolling reduction for each pass may not be particularly defined.

Hereinafter, the processes after the coiling process of the manufacturing method according to <2> will be described.

[Coiling Process]<2>

In the coiling process, the hot-rolled steel sheet after the hot rolling process is coiled at 700° C. to 500° C.

When the coiling temperature is higher than 700° C., the structure of the steel sheet changes to ferrite and pearlite structures. Therefore, the coiling temperature is set to 700° C. or lower.

On the other hand, when the coiling temperature is lower than 500° C., the structure of the steel sheet is changed to a structure mainly composed of martensite, and the strength is too high. As a result, workability is reduced. Therefore, the coiling temperature is set to 500° C. or higher.

[Cooling Process]<2>

In the cooling process, the hot-rolled steel sheet after the coiling process is cooled to room temperature. Cooling conditions are not particularly limited.

[Pickling Process]<2>

In the pickling process, the scales generated on the surface of the steel sheet after the cooling process are removed. Any pickling method may be used as long as it can remove the scales. In addition, hydrochloric acid, sulfuric acid, nitric acid, hydrofluoric acid, or a mixture thereof may be used for the pickling. Further, an inhibitor may be added to suppress the dissolution of base metal. Moreover, the pickling may be performed or may be performed a plurality of times.

[Cold Rolling Process]<2>

Cold rolling is performed on the hot-rolled steel sheet after the pickling process to obtain a cold-rolled steel sheet. In a case in which the cold rolling is performed, when the cumulative rolling reduction is less than 30%, it is difficult to keep the shape of the steel sheet flat, and the ductility of the final product is degraded. On the other hand, when the cumulative rolling reduction is greater than 70%, the rolling force becomes too high, which makes it difficult to perform cold rolling. Therefore, the cumulative rolling reduction is set in the range of 30% to 70%. It is preferable that the cumulative rolling reduction is in the range of 40% to 70%. The number of rolling passes and the rolling reduction for each pass may not be particularly defined.

[Annealing Process]<2>

In the annealing process, the cold-rolled steel sheet obtained by the cold rolling is heated to an annealing temperature of 840° C. to 900° C. and is held at this annealing temperature for 10 to 2,000 seconds.

When the annealing temperature is lower than 840° C., it is impossible to form an austenite single phase during annealing, and it is impossible for the area ratio of the upper bainite to be equal to or greater than 70% in the subsequent heat treatment. On the other hand, when the annealing temperature is higher than 950° C., the effect is saturated, and not only economy is degraded, but also bainitic transformation is delayed due to the coarsening of an austenite grain size. Therefore, it is impossible to secure 70% or more of upper bainite in the subsequent process of holding the steel sheet in a temperature range of 400° C. to 600° C. for 100 to 1,000 seconds.

Further, when the annealing time (holding time) is shorter than 10 seconds, it is impossible to dissolve the carbides formed by hot rolling, and it is impossible to form the austenite single phase during annealing. It is impossible for the area ratio of upper bainite to be equal to or greater than 70% in the subsequent heat treatment. On the other hand, when the annealing time is longer than 2000 seconds, austenite is coarsened, and bainitic transformation is delayed. Therefore, it is impossible to secure 70% or more of upper bainite in the subsequent process of holding the steel sheet in a temperature range of 400° C. to 600° C. for 100 to 1,000 seconds.

[Heat Treatment Process]<2>

In the heat treatment process, the cold-rolled steel sheet after the annealing process (after the cold-rolled steel sheet is held for a predetermined time) is cooled to a temperature range of 400° C. to 600° C., is held in this temperature range for 100 to 1.000 seconds and is then cooled to room temperature.

This heat treatment causes the area ratio of the upper bainite in the microstructure to be equal to or greater than 70% and causes iron carbides having a major axis of 0.1 μm or more to be precipitated in the upper bainite at a number density of 4/μm$^2$ or more.

When the holding temperature is higher than 600° C., ferrite or pearlite is generated, and it is impossible for the area ratio of the upper bainite to be equal to or greater than 70%. On the other hand, when the holding temperature is lower than 400° C., a structure mainly composed of martensite is obtained.

Further, when the holding time is shorter than 100 seconds, it is impossible to sufficiently obtain the area ratio of the upper bainite, and martensite is formed in the subsequent cooling. Therefore, it is impossible for the area ratio of the upper bainite to be equal to or greater than 70% in the steel sheet after cooling. On the other hand, when the holding time, is longer than 1000 seconds, the number density of iron carbides having a size of 0.1 μm or more is less than 4/μm$^2$ due to the coarsening of carbides.

After the steel sheet is held, it is cooled to room temperature. Cooling conditions are not particularly limited as long as the time for which the temperature is held at 400° C. to 600° C. is not longer than 1,000 seconds.

[Plating Process]<2>

In a case in which a plating layer is formed on the surface of the steel sheet, the cold-rolled steel sheet may be immersed in a plating bath after the annealing process and before the heat treatment process, or after the heat treatment process. In general, the bath temperature of the plating bath is 400° C. to 600° C. even in the case of zinc plating and plating including other elements. When the steel sheet is immersed in the plating bath, a plating layer is formed on the surface, and upper bainite is formed in the steel sheet. However, in a general plating apparatus, the immersion time is not longer than 100 seconds. Therefore, even when the plating process is performed, it is impossible to omit the heat treatment process.

In a case in which the plating process is performed, the upper limit of the holding, time of the heat treatment process is preferably set to a time obtained by subtracting the immersion time in the plating bath from 1,000 seconds.

[Alloying Process]<2>

After the plating process (in a case in which the plating process is performed before the heat treatment process, after the plating process and before the heat treatment process), the cold-rolled steel sheet having the plating layer formed on the surface thereof may be held in a temperature range of 450° C. to 600° C. (alloying temperature range) to alloy the plating layer.

In a case in which the plating process and the alloying process are performed, the upper limit of the holding time of the heat treatment process is preferably set to the time obtained by subtracting the immersion time in the plating bath and the time for which the steel sheet is held at 450° C. to 600° C. for alloying from 1,000 seconds.

Next, the hot stamped component according to this embodiment will be described.

<Chemical Composition>

The hot stamped component according to this embodiment is obtained by performing hot stamping on the steel sheet (steel sheet for hot stamping) according to this embodiment described above. Since the chemical composition is not substantially changed by hot stamping, the range of the chemical composition of the hot stamped component according to this embodiment is the same as that of the steel sheet according to this embodiment described above. Therefore, the description of the chemical composition is omitted, here.

<Microstructure>

[Tempered Martensite: 90 Area % or More]

The reason why the area ratio of tempered martensite is set to 90% or more is to achieve both tensile strength and bendability. When the area ratio of ferrite, upper bainite, or the like is greater than 10%, it is impossible to secure a strength of 980 MPa or more. When the area ratio of fresh martensite is greater than 10%, the angle at the time of the occurrence of cracks in a VDA test is less than 80°, which results in degradation of collision characteristics. For this reason, the content of tempered martensite is set to 90% or more.

The tempered martensite is martensite including carbides therein.

In this embodiment, the tempered martensite in the hot stamping process is secured by controlling the chemical composition of the steel sheet for hot stamping and the microstructure of the steel sheet for hot stamping, without performing a special heat, treatment. That is, the C content is limited to 0.060% to 0.120% to increase the martensitic transformation start temperature. In addition, the microstructure of the steel sheet for hot stamping is mainly composed of upper bainite to form martensite during cooling in the hot stamping process. In addition, carbides are precipitated in the martensite to form tempered martensite.

Microstructures other than the tempered martensite may include ferrite, pearlite, upper bainite, lower bainite, and fresh martensite (martensite without including carbides) as long as the area ratio thereof is less than 10%.

The area ratio of each phase of the microstructure can be measured by the following method.

First, the hot stamped component (formed body) is cut out in a direction parallel to the rolling direction, is polished, and is then etched with a nital reagent. Then, a ¼ position of the sheet thickness from the surface in the sheet thickness direction can be observed in a range of 8,000 μm$^2$ or more at a magnification of 1,000 to 30,000 using the SEM to identify ferrite, upper bainite, lower bainite, pearlite, tempered martensite, and fresh martensite. The microstructure of the hot stamped component according to this embodiment is the same in the direction parallel to the rolling direction of the steel sheet or in the direction perpendicular to the rolling direction of the steel sheet at any ¼ position of the sheet thickness from the surface in the sheet thickness direction.

At the time of identification, as in the case of the steel sheet for hot stamping, it is possible to determine the following from microstructural morphology: ferrite is an equiaxed grain without including iron carbide; pearlite is a layered structure of ferrite and cementite; upper bainite is a lath-shaped structure including cementite and residual austenite between laths: and lower bainite includes carbides in a lath. The area ratio of each structure identified from a SEM observation image is measured.

Martensite includes both tempered martensite that includes carbides in laths and as-quenched martensite (fresh martensite) without including carbides, which can be identified by being observed by a SEM or a transmission electron microscope (TEM) to check whether carbides are present or absent. For example, 10 visual fields of a range (visual field) of 30 μm×25 μm are observed at a magnification of 3,000, and the average value thereof is used as the area ratio.

<Characteristics>

The hot stamped component according to this embodiment has high strength and good collision characteristics. In this embodiment, good collision characteristics mean that the hot stamped component is difficult to fracture even when it is deformed at the time of collision and mean that the VDA maximum bending angle is equal to or greater than 80° in the method described in VDA238-100. Moreover, high strength means that the tensile strength is equal to or greater than 980 MPa.

The VDA maximum bending angle (bendability) is measured according to the method described in VDA238-100. Specifically, after the thickness of the steel sheet is reduced to 1.2 mm from one side, the VDA bending test is performed such that the hot stamping surface that has not been subjected to the thickness reduction process is on the outer side of the bending.

In VDA238-100, a test piece size is 60 mm in width and 60 mm in length. However, a flat surface of the test piece is limited, and it is difficult to collect the test piece with this size, depending on the component. For this reason, in order to measure the bendability of the formed body, the width of the test piece may be changed to evaluate the bendability. For example, the size may be changed to a test piece size of 30 mm in width and 60 mm in length.

<Method for Manufacturing Component>

Next, a method for manufacturing a hot stamped component according to this embodiment will be described.

The method for manufacturing a hot stamped component according to this embodiment includes a hot stamping process of heating the steel sheet (steel sheet for hot stamping) according to this embodiment obtained by the above-described method in a heating furnace at an ambient temperature of 850° C. to 950° C. for 3 minutes or longer and cooling the steel sheet to a martensitic transformation start temperature or lower at a cooling rate of 10° C./second or faster. Here, the cooling rate is a value obtained by dividing the difference between a take-out temperature from the furnace and cooling end temperature in a die and punch by the time from the taking-out of the steel sheet from the furnace to the end of the cooling by the die and punch. It is possible to obtain the effect of the invention without any particular limitation on the take-out temperature from die and punch (cooling end temperature in a die and punch). In a case in which the take-out temperature from die and punch is higher than 200° C., safety issues, such as burns, occur. Therefore, it is desirable that the temperature is equal to or lower than 200° C.

According to this manufacturing method, it is possible to obtain a hot stamped component in which the area ratio of tempered martensite is equal to or greater than 90% and which, has a tensile strength of 980 MPa or more and good collision characteristics.

When the ambient temperature is lower than 850° C. or the heating time is shorter than 3 minutes, austenite transformation does not occur sufficiently, and the area ratio of tempered martensite in the hot stamped component is not equal to or greater than 90%. In this case, sufficient strength is not obtained.

On the other hand, when the ambient temperature is higher than 950° C., the effect is saturated, and the austenite grains are excessively coarsened. As a result, TS is reduced, which is not preferable.

EXAMPLES

Example 1

A slab having a chemical composition shown in Table 1 was cast. After the slab was heated to 1,150° C. to 1.300° C., hot, rolling was performed to a finishing rolling temperature shown in Table 2A to obtain a hot-rolled steel sheet (HR) having a sheet thickness of 4.0 mm.

Then, the steel sheet was coiled at the coiling temperature shown in Table 2A and was held at 500° C. to 450° C. for the time shown in Table 2A.

Then, the steel sheet was cooled to room temperature by air cooling.

In addition, then, some of the steel sheets were pickled to remove scales generated on the surfaces, and cold rolling was performed on the steel sheet at a cumulative rolling reduction of 50% to obtain a cold-rolled steel sheet (FH) with a sheet thickness of 2.0 mm.

In the obtained steel sheet (hot-rolled steel sheet or cold-rolled steel sheet), a microstructure at a ¼ position of the sheet thickness from the surface was observed by the above-described method to measure the area ratio of upper bainite and the number density of iron carbides having a major axis of 0.1 μm or more.

The results are shown in Tables 2A and 2B.

In Tables 2A and 2B, the first letters A to N and a to m of the steel numbers indicate that steels having chemical compositions A to N and a to m in Table 1 were used.

Moreover, the tensile strength of the obtained steel sheet was measured by the above-described method.

In addition, a sample with a size of 350 mm×650 mm was collected from the obtained steel sheet. To simulate hot stamping with a hat component-shaped die and punch, this sample was heated in a furnace at a temperature of 910° C. for 6 minutes and immediately cooled at the cooling rate shown in Table 2B by die and punch. The cooling rate was a value obtained by dividing the difference between the take-out temperature from the furnace and the take-out temperature from the die and punch by the time from the taking-out of the steel sheet from the furnace to the end of the cooling by the die and punch.

In the sample (hot stamped component) after the end of the cooling by the die and punch, a microstructure at a ¼ position of the sheet thickness from the surface was observed by the above-described method.

In addition, the tensile strength of the sample (hot stamped component (formed body)) after the end of the cooling by the die and punch was measured by collecting a JIS No. 5 tensile test piece from the sample and performing a tensile test according to JIS Z 2241:2011. It was determined that the hardenability of the steel sheet was sufficient when the tensile strength (TS) was equal to or greater than 980 MPa.

The results are shown in Table 2B.

Moreover, a bending test piece having a size of 50×50 mm was collected from the sample (formed body) after the end of the cooling by the die and punch. At that time, the test piece was ground from one side until the sheet thickness was 1.2 mm. Then, the VDA bending test was performed according to VDA238-100 such that a polished surface was a punch side. It was determined that, when the VDA maximum bending angle was equal to or greater than 80°, good collision characteristics were obtained (it was possible to suppress cracks during large deformation).

The results are shown in Table 2B.

TABLE 1

| Steel | Chemical composition (mass %, remainder is Fe and impurities) | | | | | | | | | | |
|---|---|---|---|---|---|---|---|---|---|---|---|
| No. | C | Si | Mn | P | S | Al | Ti | B | N | Others | Remarks |
| A | 0.084 | 0.21 | 1.98 | 0.009 | 0.0031 | 0.023 | 0.025 | 0.0019 | 0.0041 | — | Steel according to the invention |
| B | 0.076 | 0.09 | 2.24 | 0.006 | 0.0012 | 0.046 | 0.019 | 0.0016 | 0.0019 | Cr = 0.18 | Steel according to the invention |
| C | 0.119 | 0.16 | 1.67 | 0.008 | 0.0032 | 0.016 | 0.015 | 0.0029 | 0.0011 | Cr = 0.39 | Steel according to the invention |
| D | 0.091 | 0.22. | 1.63 | 0.011 | 0.0019 | 0.026 | 0.034 | 0.0036 | 0.0035 | Ni = 0.56 | Steel according to the invention |
| E | 0.088 | 0.32 | 2.34 | 0.012 | 0.0022 | 0.031 | 0.019 | 0.0029 | 0.0029 | Cu = 0.22 | Steel according to the invention |
| F | 0.091 | 0.61 | 2.71 | 0.008 | 0.0027 | 0.011 | 0.022 | 0.0009 | 0.0024 | Mo = 0.11 | Steel according to the invention |
| G | 0.085 | 0.26 | 2.53 | 0.006 | 0.0016 | 0.045 | 0.027 | 0.0024 | 0.0023 | Nb = 0.049 | Steel according to the invention |
| H | 0.079 | 0.24 | 1.98 | 0.023 | 0.0023 | :0.019 | 0.020 | 0.0013 | 0.0026 | V = 0.066 | Steel according to the invention |
| I | 0:081 | 0.19 | 1.88 | 0.016 | 0.0034 | 0.022 | 0.023 | 0.0026 | 0.0024 | W = 0.019 | Steel according to the invention |
| J | 0.084 | 0.23 | 2.01 | 0.022 | 0.0009 | 0.027 | 0.019 | 0.0037 | 0.0027 | Sn = 0.13 | Steel according to the invention |
| K | 0.090 | 0.33 | 2.16 | 0.011 | 0.0024 | 0.030 | 0.028 | 0.0046 | 0.0020 | Ca = 0.0013 | Steel according to the invention |
| L | 0.087 | 0.24 | 2.24 | 0.010 | 0.0020 | 0.031 | 0.016 | 0.0013 | 0.0019 | Mg = 0.0013 | Steel according to the invention |
| M | 0.099 | 0.22 | 1.88 | 0.007 | 0.0006 | 0.026 | 0.033 | 0.0022 | 0.0016 | REM = 0.0056 | Steel according to the invention |
| N | 0.105 | 0.25 | 1.90 | 0.013 | 0.0011 | 0.024 | 0.027 | 0.0029 | 0.0035 | Cr = 0.19<br>Nb = 0.019 | Steel according to the invention |
| a | 0.054 | 0.19 | 1.99 | 0.005 | 0.0039 | 0.029 | 0.023 | 0.0019 | 0.0034 | — | Steel according to comparative example |
| b | 0.213 | 0.23 | 2.56 | 0.010 | 0.0013 | 0.034 | 0.033 | 0.0012 | 0.0026 | — | Steel according to comparative example |
| c | 0.091 | 1.12 | 1.72 | 0.008 | 0.0033 | 0.051 | 0.027 | 0.0029 | 0.0030 | — | Steel according to comparative example |
| d | 0.085 | 0.26 | 1.36 | 0.013 | 0.0029 | 0.035 | 0.030 | 0.0023 | 0.0027 | — | Steel according to comparative example |
| e | 0.089 | 0.31 | 3.36 | 0.008 | 0.0037 | 0.016 | 0.024 | 0.0018 | 0.0026 | — | Steel according to comparative example |
| f | 0.079 | 0.19 | 2.23 | 0.1328 | 0.0042 | 0.037 | 0.029 | 0.0024 | 0.0031 | — | Steel according to comparative example |
| g | 0.091 | 0.24 | 2.33 | 0.005 | 0.0106 | 0.026 | 0.031 | 0.0026 | 0.0019 | — | Steel according to comparative example |
| h | 0.101 | 0.28 | 1.99 | 0.006 | 0.0029 | 0.024 | 0.001 | 0.0020 | 0.0007 | — | Steel according to comparative example |
| i | 0.092 | 0.46 | 2.15 | 0.009 | 0.0016 | 0.035 | 0.055 | 0.0023 | 0.0026 | — | Steel according to comparative example |
| j | 0.086 | 0.29 | 2.22 | 0.006 | 0.0027 | 0.033 | 0.035 | 0.0003 | 0.0040 | — | Steel according to comparative example |
| k | 0.077 | 0.22 | 1.89 | 0.008 | 0.0026 | 0.037 | 0.031 | 0.0104 | 0.0024 | — | Steel according to comparative example |

TABLE 1-continued

| Steel No. | Chemical composition (mass %, remainder is Fe and impurities) C | Si | Mn | P | S | Al | Ti | B | N | Others | Remarks |
|---|---|---|---|---|---|---|---|---|---|---|---|
| 1 | 0.094 | 0.30 | 2.09 | 0.007 | 0.0031 | 0.028 | 0.022 | 0.0027 | 0.0114 | — | Steel according to comparative example |
| m | 0.098 | 0.24 | 2.27 | 0.009 | 0.0030 | 0.350 | 0.027 | 0.0020 | 0.0023 | — | Steel according to comparative example |

An underlined part indicates that the value is out of the range of the invention.
"—" means that each element is not added.

TABLE 2A

| Steel No. | Steel type *1 | Finishing rolling temperature (° C.) | Coiling temperature (° C.) | Holding time at 500° C. to 450° C. (hr) | Cold rolling Cumulative rolling reduction (%) | Microstructure of sheet steel Upper bainite (area %) | Structure of remainder | TS of steel sheet (MPa) |
|---|---|---|---|---|---|---|---|---|
| A1 | HR | 890 | 540 | 3.0 | — | 84 | Ferrite | 845 |
| B1 | HR | 920 | 25 | 0.0 | — | 0 | Martensite | 1126 |
| B2 | HR | 950 | 490 | 0.5 | — | 45 | Martensite | 1089 |
| B3 | HR | 960 | 560 | 1.2 | — | 100 | — | 889 |
| B4 | HR | 890 | 490 | 2.0 | — | 100 | — | 864 |
| B5 | HR | 900 | 500 | 5.0 | — | 100 | — | 841 |
| B6 | HR | 900 | 480 | 8.0 | — | 100 | — | 842 |
| B7 | FH | 930 | 500 | 5.0 | 50 | 100 | — | 849 |
| B8 | FH | 920 | 680 | 0.8 | 50 | 45 | Ferrite, Pearlite | 696 |
| C1 | HR | 900 | 500 | 6.0 | — | 100 | — | 856 |
| C2 | FH | 890 | 480 | 4.0 | 50 | 100 | — | 949 |
| D1 | HR | 890 | 480 | 5.0 | — | 100 | — | 850 |
| E1 | HR | 930 | 470 | 3.0 | — | 100 | — | 839 |
| F1 | HR | 950 | 490 | 6.0 | — | 100 | — | 851 |
| G1 | HR | 930 | 500 | 5.0 | — | 100 | — | 844 |
| H1 | HR | 940 | 480 | 4.0 | — | 100 | — | 840 |
| I1 | HR | 940 | 490 | 5.0 | — | 100 | — | 856 |
| J1 | HR | 890 | 460 | 2.0 | — | 100 | — | 824 |
| K1 | HR | 960 | 450 | 1.0 | — | 100 | — | 849 |
| L1 | HR | 910 | 470 | 5.0 | — | 100 | — | 850 |
| M1 | HR | 920 | 490 | 5.0 | — | 100 | — | 855 |
| N1 | HR | 900 | 500 | 7.0 | — | 100 | — | 836 |
| a1 | HR | 940 | 480 | 5.0 | — | 64 | Ferrite | 762 |
| b1 | HR | 900 | 500 | 7.0 | — | 100 | — | 1195 |
| c1 | HR | 890 | 480 | 3.0 | — | 65 | Ferrite | 945 |
| d1 | HR | 940 | 560 | 2.0 | — | 33 | Ferrite, Pearlite | 578 |
| e1 | HR | 920 | 470 | 4.0 | — | 33 | Martensite | 1087 |
| f1 | HR | 960 | 480 | 5.0 | — | 87 | Ferrite | 769 |
| g1 | HR | 930 | 600 | 5.0 | — | 91 | Ferrite | 788 |
| h1 | HR | 900 | 600 | 4.0 | — | 16 | Ferrite, Pearlite | 561 |
| i1 | HR | 880 | 540 | 6.0 | — | 64 | Ferrite, Pearlite | 710 |
| j1 | HR | 940 | 480 | 5.0 | — | 56 | Ferrite, Pearlite | 599 |
| k1 | HR | 950 | 460 | 3.0 | — | 100 | — | 826 |
| l1 | HR | 920 | 500 | 7.0 | — | 60 | Ferrite, Pearlite | 742 |
| m1 | HR | 930 | 600 | 4.0 | — | 58 | Ferrite, Pearlite | 645 |

*1 HR means a hot-rolled steel sheet, FH means that cold rolling is maintained, CR means a cold-rolled steel sheet annealed after cold rolling, GI means a hot-dip galvanized steel sheet, and GA means a galvannealed steel sheet.

TABLE 2B

| Steel No. | Number density of iron carbides having major axis of 0.1 μm or more (number of items/μm$^2$) | Cooling rate during hot stamping (° C./s) | Microstructure of hot stamped component (formed body) Tempered martensite (area %) | Structure of remainder | TS of formed body (MPa) | VDA bending angle of formed body (°) | Remarks |
|---|---|---|---|---|---|---|---|
| A1 | 5 | 12 | 100 | — | 1083 | 84 | Example of the invention |
| B1 | 0 | 12 | 76 | Fresh martensite | 1052 | 70 | Comparative example |

TABLE 2B-continued

| Steel No. | Number density of iron carbides having major axis of 0.1 μm or more (number of items/μm²) | Cooling rate during hot stamping (° C./s) | Microstructure of hot stamped component (formed body) Tempered martensite (area %) | Structure of remainder | TS of formed body (MPa) | VDA bending angle of formed body (°) | Remarks |
|---|---|---|---|---|---|---|---|
| B2 | 1 | 12 | 83 | Fresh martensite | 1066 | 76 | Comparative example |
| B3 | 5 | 12 | 100 | — | 1064 | 89 | Example of the invention |
| B4 | 6 | 12 | 100 | — | 1070 | 93 | Example of the invention |
| B5 | 7 | 12 | 100 | — | 1068 | 92 | Example of the invention |
| B6 | 5 | 12 | 100 | — | 1076 | 95 | Example of the invention |
| B7 | 6 | 18 | 100 | — | 1081 | 94 | Example of the invention |
| B8 | 1 | 18 | 83 | Upper bainite | 948 | 72 | Comparative example |
| C1 | 5 | 12 | 100 | — | 1146 | 85 | Example of the invention |
| C2 | 6 | 18 | 100 | — | 1056 | 83 | Example of the invention |
| D1 | 5 | 12 | 100 | — | 1101 | 88 | Example of the invention |
| E1 | 6 | 12 | 100 | — | 1087 | 90 | Example of the invention |
| F1 | 5 | 12 | 100 | — | 1109 | 86 | Example of the invention |
| G1 | 6 | 12 | 100 | — | 1072 | 88 | Example of the invention |
| H1 | 5 | 12 | 100 | — | 1067 | 87 | Example of the invention |
| I1 | 6 | 12 | 100 | — | 1070 | 88 | Example of the invention |
| J1 | 5 | 12 | 100 | — | 1079 | 90 | Example of the invention |
| K1 | 5 | 12 | 100 | — | 1139 | 84 | Example of the invention |
| L1 | 5 | 12 | 100 | — | 1084 | 86 | Example of the invention |
| M1 | 5 | 12 | 100 | — | 1163 | 84 | Example of the invention |
| N1 | 5 | 12 | 100 | — | 1189 | 82 | Example of the invention |
| a1 | 2 | 12 | 71 | Upper bainite | 846 | 109 | Comparative example |
| b1 | 6 | 12 | 45 | Fresh martensite | 1513 | 52 | Comparative example |
| c1 | 2 | 12 | 71 | Upper bainite, Residual austenite | 1024 | 67 | Comparative example |
| d1 | 1 | 12 | 56 | Ferrite, Upper bainite | 842 | 89 | Comparative example |
| e1 | 0 | 12 | 81 | Fresh martensite | 1149 | 76 | Comparative example |
| f1 | 0 | 12 | 86 | Ferrite, Upper bainite | 1023 | 65 | Comparative example |
| g1 | 0 | 12 | 84 | Upper bainite, Fresh martensite | 1078 | 69 | Comparative example |
| h1 | 0 | 12 | 22 | Ferrite, Upper bainite | 819 | 95 | Comparative example |
| i1 | 3 | 12 | 54 | Ferrite, Upper bainite | 962 | 84 | Comparative example |
| j1 | 2 | 12 | 16 | Ferrite, Upper bainite | 789 | 99 | Comparative example |
| k1 | 5 | 12 | 86 | Upper bainite | 1054 | 74 | Comparative example |
| l1 | 2 | 12 | 69 | Upper bainite | 846 | 76 | Comparative example |
| m1 | 3 | 12 | 79 | Upper bainite | 925 | 70 | Comparative example |

As can be seen from Tables 1 and 2A to 2B, in the example of the invention, the tensile strength (TS) was equal to or greater than 980 MPa, and the VDA maximum bending angle was equal to or greater than 80° after hot stamping.

In contrast, in a comparative example, at least one of the tensile strength (TS) or the VDA maximum bending angle after hot stamping was degraded.

Example 2

A slab having the chemical composition shown in Table 1 was heated to 1,180° C. to 1,250° C., and then hot rolling was performed on the slab such that a finishing temperature is 880° C. to 960° C. to obtain a hot-rolled steel sheet having a sheet thickness of 4.0 mm. Then, the hot-rolled steel sheet was coiled at a coiling temperature of 700° C. to 500° C., was cooled to room temperature by air cooling, and was then pickled to remove scales generated on the surface. Further, cold rolling was performed on the hot-rolled steel sheet at a cumulative rolling reduction of 50% to obtain a cold-rolled steel sheet having a sheet thickness of 2.0 mm.

Furthermore, annealing and heat treatment were performed on the cold-rolled steel sheet under the conditions shown in Table 3A to obtain a cold-rolled steel sheet (CR).

A microstructure of the obtained steel sheet was observed in the same manner as that in Example 1 to measure the area ratio of upper bainite and the number density of iron carbides having a major axis of 0.1 μm or more. In addition, a tensile test was performed to measure tensile strength.

The results are shown in Tables 3A and 3B.

In addition, a sample with a size of 350×650 mm was collected from the obtained steel sheet. Then, to simulate hot stamping with a hat component-shaped die and punch, this sample was heated in a furnace with a temperature of 910° C. for 4 minutes and immediately cooled by die and punch. A cooling rate was as shown in Table 3C. The cooling rate was a value obtained by dividing the difference between the take-out temperature from the furnace and the take-out temperature from the die and punch by the time from the taking-out of the steel sheet from the furnace to the end of the cooling by the die and punch.

A microstructure was observed from the sample (formed body) after the end of the cooling by the die and punch in the same manner as that in Example 1. In addition, a tensile test was performed in the same manner as that in Example 1 to measure tensile strength. It was determined that the hardenability of the steel sheet was sufficient when the tensile strength (TS) was equal to or greater than 980 MPa.

The results are shown in Table 3B.

In addition, the VDA bending test was performed on the sample (formed body) after the end of the cooling by the die and punch in the same manner as that in Example 1. It was determined that, when the VDA maximum bending angle was equal to or greater than 80°, good collision characteristics were obtained (it was possible to suppress cracks during large deformation).

The results are shown in Table 3B.

In Tables 3A and 3B, the first letters A to N and a to m of the steel numbers indicate that steels having chemical compositions A to N and a to m in Table 1 were used.

TABLE 3A

| Steel No. | Steel type *1 | Annealing temperature (° C.) | Annealing holding time (s) | Heat treatment process cooling stop temperature (° C.) | Heat treatment process holding temperature (° C.) | Holding time in temperature range of 400° C. to 600° C. (s) | Microstructure of steel sheet Upper bainite (area %) | Microstructure of steel sheet Structure of remainder | TS of steel sheet (MPa) |
|---|---|---|---|---|---|---|---|---|---|
| A11 | CR | 850 | 220 | 420 | 420 | 440 | 100 | Ferrite | 862 |
| B11 | CR | 860 | 220 | 25 | 25 | 0 | 0 | Martensite | 1126 |
| B12 | CR | 860 | 220 | 200 | 200 | 0 | 0 | Martensite | 1067 |
| B13 | CR | 850 | 220 | 420 | 420 | 20 | 43 | Martensite | 1039 |
| B14 | CR | 860 | 220 | 450 | 450 | 440 | 100 | — | 886 |
| B15 | CR | 870 | 100 | 420 | 420 | 200 | 100 | — | 902 |
| B16 | CR | 860 | 80 | 420 | 450 | 160 | 100 | — | 887 |
| B17 | CR | 850 | 200 | 420 | 440 | 400 | 100 | — | 905 |
| B18 | CR | 860 | 60 | 640 | 640 | 120 | 0 | Ferrite, Pearlite | 675 |
| C11 | CR | 850 | 130 | 410 | 440 | 260 | 100 | — | 869 |
| C12 | CR | 860 | 220 | 180 | 210 | 0 | 0 | Martensite | 1456 |
| D11 | CR | 850 | 200 | 430 | 400 | 400 | 100 | — | 869 |
| E11 | CR | 850 | 160 | 450 | 450 | 320 | 100 | — | 887 |
| F11 | CR | 850 | 80 | 430 | 470 | 160 | 100 | — | 924 |
| G11 | CR | 850 | 200 | 420 | 440 | 400 | 100 | — | 865 |
| H11 | CR | 860 | 60 | 450 | 450 | 120 | 100 | — | 931 |
| I11 | CR | 850 | 300 | 400 | 400 | 600 | 100 | — | 842 |
| J11 | CR | 850 | 200 | 420 | 440 | 400 | 100 | — | 856 |
| K11 | CR | 850 | 180 | 430 | 460 | 360 | 100 | — | 850 |
| L11 | CR | 850 | 160 | 470 | 450 | 320 | 100 | — | 862 |
| M11 | CR | 860 | 120 | 410 | 430 | 240 | 100 | — | 879 |
| N11 | CR | 860 | 100 | 420 | 400 | 200 | 100 | — | 906 |
| a11 | CR | 840 | 180 | 440 | 420 | 360 | 66 | Ferrite | 812 |
| b11 | CR | 850 | 120 | 460 | 480 | 240 | 100 | — | 1369 |
| c11 | CR | 870 | 120 | 480 | 450 | 240 | 62 | Ferrite | 975 |
| d11 | CR | 850 | 120 | 460 | 460 | 240 | 29 | Ferrite, Pearlite | 624 |
| e11 | CR | 860 | 150 | 450 | 440 | 300 | 35 | Martensite | 1163 |
| f11 | CR | 850 | 200 | 450 | 450 | 400 | 81 | Ferrite | 803 |
| g11 | CR | 860 | 120 | 430 | 400 | 240 | 85 | Ferrite | 824 |
| h11 | CR | 850 | 160 | 420 | 400 | 320 | 9 | Ferrite, Pearlite | 575 |
| i11 | CR | 870 | 200 | 420 | 430 | 400 | 55 | Ferrite, Pearlite | 726 |
| j11 | CR | 850 | 80 | 450 | 470 | 160 | 48 | Ferrite, Pearlite | 603 |
| k11 | CR | 880 | 120 | 450 | 450 | 240 | 100 | — | 862 |
| l11 | CR | 850 | 120 | 440 | 450 | 240 | 63 | Ferrite, Pearlite. | 716 |
| m11 | CR | 840 | 360 | 410 | 440 | 720 | 42 | Ferite, Pearlite | 674 |

*1 HR means a hot-rolled steel sheet, FH means that cold rolling is maintained, CR means a cold-rolled steel sheet annealed after cold rolling, GI means a hot-dip galvanized steel sheet, and GA means a galvannealed steel sheet.

TABLE 3B

| Steel No. | Number density of iron carbides having major axis of 0.1 μm or more (number of items/μm$^2$) | Cooling rate during hot stamping (° C./s) | Microstructure of hot stamped component (formed body) Tempered martensite (area %) | Microstructure of hot stamped component (formed body) Structure of remainder | TS of formed body (MPa) | VDA bending angle of formed body (°) | Remarks |
|---|---|---|---|---|---|---|---|
| A11 | 6 | 18 | 100 | — | 1077 | 88 | Example of the invention |
| B11 | 0 | 18 | 72 | Upper bainite, Fresh martensite | 1049 | 69 | Comparative example |
| B12 | 0 | 18 | 78 | Upper bainite, Fresh martensite | 1058 | 72 | Comparative example |
| B13 | 2 | 18 | 84 | Fresh martensite | 1062 | 74 | Comparative example |
| B14 | 5 | 18 | 100 | — | 1069 | 91 | Example of the invention |
| B15 | 6 | 18 | 100 | — | 1070 | 90 | Example of the invention |
| B16 | 7 | 18 | 100 | — | 1081 | 94 | Example of the invention |
| B17 | 6 | 18 | 100 | — | 1079 | 97 | Example of the invention |
| B18 | 0 | 18 | 79 | Upper bainite | 937 | 75 | Comparative example |
| C11 | 6 | 18 | 100 | — | 1053 | 88 | Example of the invention |

TABLE 3B-continued

| Steel No. | Number density of iron carbides having major axis of 0.1 μm or more (number of items/μm²) | Cooling rate during hot stamping (° C./s) | Microstructure of hot stamped component (formed body) Tempered martensite (area %) | Structure of remainder | TS of formed body (MPa) | VDA bending angle of formed body (°) | Remarks |
|---|---|---|---|---|---|---|---|
| C12 | 0 | 18 | 86 | — | 851 | 71 | Comparative example |
| D11 | 6 | 18 | 100 | — | 1099 | 86 | Example of the invention |
| E11 | 7 | 18 | 100 | — | 1091 | 92 | Example of the invention |
| F11 | 5 | 18 | 100 | — | 1122 | 88 | Example of the invention |
| G11 | 5 | 18 | 100 | — | 1080 | 85 | Example of the invention |
| H11 | 6 | 18 | 100 | — | 1056 | 84 | Example of the invention |
| I11 | 5 | 18 | 100 | — | 1059 | 88 | Example of the invention |
| J11 | 7 | 18 | 100 | — | 1083 | 92 | Example of the invention |
| K11 | 6 | 18 | 100 | — | 1046 | 90 | Example of the invention |
| L11 | 5 | 18 | 100 | — | 1090 | 83 | Example of the invention |
| M11 | 5 | 18 | 100 | — | 1072 | 87 | Example of the invention |
| N11 | 6 | 18 | 100 | — | 1094 | 85 | Example of the invention |
| a11 | 1 | 18 | 76 | Upper bainite | 837 | 105 | Comparative example |
| b11 | 7 | 18 | 39 | Fresh martensite | 1526 | 56 | Comparative example |
| c11 | 2 | 18 | 66 | Upper bainite, Residual austenite | 1011 | 70 | Comparative example |
| d11 | 2 | 18 | 58 | Ferrite, Upper bainite | 832 | 84 | Comparative example |
| e11 | 1 | 18 | 79 | Fresh martensite | 1111 | 75 | Comparative example |
| f11 | 3 | 18 | 84 | Ferrite, Upper bainite | 1034 | 61 | Comparative example |
| g11 | 3 | 18 | 83 | Upper bainite, Fresh martensite | 1089 | 70 | Comparative example |
| h11 | 0 | 18 | 25 | Ferrite, Upper bainite | 799 | 94 | Comparative example |
| i11 | 2 | 18 | 49 | Ferrite, Upper bainite | 942 | 82 | Comparative example |
| j11 | 3 | 18 | 12 | Ferrite, Upper bainite | 773 | 102 | Comparative example |
| k11 | 6 | 18 | 82 | Upper bainite | 1038 | 71 | Comparative example |
| l11 | 3 | 18 | 64 | Upper bainite | 829 | 79 | Comparative example |
| m11 | 3 | 18 | 73 | Upper bainite | 899 | 62 | Comparative example |

As can be seen from Tables 1 and 3A to 3B, in the example of the invention, the tensile strength (TS) was equal to or greater than 980 MPa, and the VDA maximum bending angle is equal to or greater than 80° after hot stamping.

In contrast, in a comparative example, at least one of the tensile strength (TS) or the VITA maximum bending angle after hot stamping, was degraded.

Example 3

A slab having the chemical composition shown in Table 1 was heated to 1,180° C. to 1,250° C., and then hot rolling was performed on the slab such that a finishing temperature is 880° C. to 960° C. to obtain a hot-rolled steel sheet having a sheet thickness of 4.0 mm. Then, the hot-rolled steel sheet was coiled at a coiling temperature of 680° C. to 500° C. was cooled to room temperature by air cooling, and was then pickled to remove scales generated on the surface. Further, cold rolling was performed on the hot-rolled steel sheet at a cumulative rolling reduction of 50% to obtain a cold-rolled steel sheet having a sheet thickness of 2.0 mm.

Furthermore, annealing and heat treatment were performed on the cold-rolled steel sheet under the conditions shown in Table 4A to obtain a cold-rolled steel sheet (CR).

Then, an annealing process, a heat treatment process, and a plating process were performed using a hot-dip galvanizing facility. If necessary, an alloying process was performed. The plating process and the alloying process were performed after the annealing process and before the heat treatment process, or after the heat treatment process.

As a result, a hot-dip galvanized steel sheet (GI) or a galvannealed steel sheet (GA) was obtained.

A microstructure of the obtained steel sheet was observed in the same manner as that in Example 1 to measure the area ratio of upper bainite and the number density of iron carbides having a major axis of 0.1 μm or more. In addition, a tensile test was performed to measure tensile strength.

The results are shown in Tables 4B and 4C.

In addition, a sample with a size of 350×650 mm was collected from the obtained steel sheet. Then, to simulate hot stamping, this sample was heated in a furnace with a temperature of 910° C. for 4 minutes and immediately cooled by die and punch. A cooling rate was as shown in Table 4C. The cooling rate was a value obtained by dividing the difference between the take-out temperature from the furnace and the take-out temperature from the die and punch by the time from the taking-out of the steel sheet from the furnace to the end of the cooling by the die and punch.

A microstructure was observed from the sample (formed body) after the end of the cooling by the die and punch in the same manner as that in Example 1. In addition, a tensile test was performed in the same manner as that in Example 1 to measure tensile strength. It was determined that the hardenability of the steel sheet was sufficient when the tensile strength (TS) was equal to or greater than 980 MPa.

The results are shown in Table 4C.

In addition, the VISA bending test was performed on the sample (formed body) after the end of the cooling by the die and punch in the same manner as that in Example 1. It was determined that, when the VDA maximum bending angle was equal to or greater than 80°, good collision characteristics were obtained (it was possible to suppress cracks during large deformation).

The results are shown in Table 4C.

In Tables 4A to 4C, the first letters A to N and a to m of the steel numbers indicate that steels having the chemical compositions A to N and a to m in Table 1 were used.

TABLE 4A

| Steel No. | Steel type *1 | Annealing temperature (° C.) | Annealing holding time (s) | Heat treatment process Cooling stop temperature (° C.) | Holding temperature (° C.) | Holding time in temperature range of 400° C. to 600° C. (s) |
|---|---|---|---|---|---|---|
| A21 | GA | 860 | 90 | 420 | 410 | 120 |
| B21 | GA | 850 | 90 | *2 | *2 | 0 |
| B24 | GA | 850 | 160 | 440 | 420 | 200 |
| B25 | GA | 880 | 120 | 450 | 430 | 160 |
| B26 | GA | 860 | 160 | 470 | 450 | 200 |
| B27 | GA | 860 | 380 | 450 | 450 | 460 |
| B28 | GA | 850 | 600 | 700 | 660 | 720 |
| B29 | GI | 860 | 90 | 440 | 410 | 120 |
| B30 | GI | 870 | 90 | *2 | *2 | 0 |
| C21 | GA | 850 | 160 | 420 | 450 | 200 |
| C22 | GA | 870 | 160 | *2 | *2 | 0 |
| C23 | GI | 850 | 200 | 410 | 420 | 240 |
| D21 | GA | 860 | 160 | 420 | 420 | 200 |
| E21 | GA | 850 | 160 | 450 | 440 | 200 |
| F21 | GA | 860 | 130 | 430 | 430 | 160 |
| G21 | GA | 850 | 90 | 410 | 420 | 120 |
| H21 | GA | 860 | 360 | 440 | 450 | 440 |
| I21 | GA | 860 | 160 | 430 | 430 | 200 |
| J21 | GA | 850 | 320 | 420 | 400 | 400 |
| K21 | GA | 860 | 240 | 410 | 420 | 320 |
| L21 | GA | 850 | 130 | 440 | 430 | 160 |
| M21 | GA | 870 | 90 | 420 | 410 | 120 |
| N21 | GA | 860 | 280 | 410 | 400 | 400 |
| a21 | GA | 840 | 180 | 420 | 410 | 240 |
| b21 | GA | 860 | 90 | 460 | 490 | 120 |
| c21 | GA | 880 | 90 | 450 | 440 | 120 |
| d21 | GA | 860 | 120 | 430 | 420 | 160 |
| e21 | GA | 860 | 140 | 450 | 440 | 200 |
| f21 | GA | 860 | 110 | 440 | 450 | 160 |
| g21 | GA | 860 | 160 | 450 | 430 | 200 |
| h21 | GA | 850 | 120 | 420 | 410 | 160 |
| i21 | GA | 860 | 90 | 430 | 420 | 120 |
| j21 | GA | 860 | 120 | 460 | 490 | 160 |
| k21 | GA | 860 | 120 | 450 | 420 | 160 |
| l21 | GA | 860 | 135 | 450 | 430 | 180 |
| m21 | GA | 840 | 150 | 430 | 400 | 200 |

*1 HR means a hot-rolled steel sheet, FH means that cold rolling is maintained, CR means a cold-rolled steel sheet annealed after cold rolling, GI means a hot-dip galvanized steel sheet, and GA means a galvannealed steel sheet.
*2 means that holding at 400° C. to 600° C. is not performed.

TABLE 4B

| Steel No. | Presence or absence of alloying | Timing of heat treatment at 400° C. to 600° C. | Microstructure of steel sheet: Upper bainite (area %) | Microstructure of steel sheet: Structure of remainder | TS of steel sheet (MPa) |
|---|---|---|---|---|---|
| A21 | Presence | Before plating process | 100 | Ferrite | 892 |
| B21 | Presence | *2 | 0 | Martensite | 1142 |
| B24 | Presence | Before plating process | 100 | — | 872 |
| B25 | Presence | After plating process and alloying heat treatment | 100 | — | 869 |
| B26 | Presence | Before plating process | 100 | — | 892 |
| B27 | Presence | After plating process and alloying heat treatment | 100 | — | 846 |
| B28 | Presence | Before plating process | 0 | Ferrite, Pearlite | 592 |
| B29 | Absence | Before plating process | 100 | — | 857 |
| B30 | Absence | *2 | 0 | Martensite | 1152 |
| C21 | Presence | Before plating process | 100 | — | 880 |
| C22 | Presence | *2 | 0 | Martensite | 1042 |
| C23 | Absence | After plating process | 100 | — | 892 |
| D21 | Presence | Before plating process | 100 | — | 902 |
| E21 | Presence | Before plating process | 100 | — | 883 |
| F21 | Presence | Before plating process | 100 | — | 903 |
| G21 | Presence | Before plating process | 100 | — | 911 |
| H21 | Presence | Before plating process | 100 | — | 899 |
| I21 | Presence | Before plating process | 100 | — | 904 |
| J21 | Presence | Before plating process | 100 | — | 895 |
| K21 | Presence | Before plating process | 100 | — | 910 |
| L21 | Presence | Before plating process | 100 | — | 896 |

TABLE 4B-continued

| Steel No. | Presence or absence of alloying | Timing of heat treatment at 400° C. to 600° C. | Microstructure of steel sheet Upper bainite (area %) | Structure of remainder | TS of steel sheet (MPa) |
|---|---|---|---|---|---|
| M21 | Presence | Before plating process | 100 | — | 886 |
| N21 | Presence | Before plating process | 100 | — | 907 |
| a21 | Presence | Before plating process | 68 | Ferrite | 845 |
| b21 | Presence | Before plating process | 100 | — | 1416 |
| c21 | Presence | Before plating process | 66 | Ferrite | 979 |
| d21 | Presence. | Before plating process | 32 | Ferrite, Pearlite | 678 |
| e21 | Presence | Before plating process | 39 | Martensite | 1206 |
| f21 | Presence | Before plating process | 78 | Ferrite | 903 |
| g21 | Presence | Before plating process | 84 | Ferrite | 889 |
| h21 | Presence | Before plating process | 11 | Ferrite, Pearlite | 645 |
| i21 | Presence | Before plating process | 52 | Ferrite, Pearlite | 798 |
| j21 | Presence | Before plating process | 52 | Ferrite, Pearlite | 702 |
| k21 | Presence | Before plating process | 100 | — | 934 |
| l21 | Presence | Before plating process | 59 | Ferrite, Pearlite | 791 |
| m21 | Presence | Before plating process | 46 | Ferrite, Pearlite. | 734 |

*1 HR means a hot-rolled steel sheet, FH means that cold rolling is maintained, CR means a cold-rolled steel sheet annealed after cold rolling, GI means a hot-dip galvanized steel sheet, and GA means a galvannealed steel sheet.
*2 means that holding at 400° C. to 600° C. is not performed.

TABLE 4C

| Steel No. | Number density of iron carbides having major axis of 0.1 μm or more (number of items/μm$^3$) | Cooling rate during hot stamping (° C./s) | Microstructure of hot stamped component (formed body) Tempered martensite (area %) | Structure of remainder | TS of formed body (MPa) | VDA bending angle of formed body (°) | Remarks |
|---|---|---|---|---|---|---|---|
| A21 | 5 | 18 | 100 | — | 1082 | 87 | Example of the invention |
| B21 | 0 | 18 | 82 | Fresh martensite. | 1055 | 62 | Comparative example |
| B24 | 6 | 18 | 100 | — | 1064 | 90 | Example of the invention |
| B25 | 6 | 18 | 100 | — | 1081 | 94 | Example of the invention |
| B26 | 6 | 18 | 100 | — | 1072 | 89 | Example of the invention |
| B27 | 7 | 18 | 100 | — | 1069 | 95 | Example of the invention |
| B28 | 0 | 18 | 81 | Upper bainite | 928 | 72 | Comparative example |
| B29 | 5 | 18 | 100 | — | 1045 | 89 | Example of the invention |
| B30 | 0 | 18 | 85 | Fresh martensite | 935 | 74 | Comparative example |
| C21 | 5 | 18 | 100 | — | 1048 | 90 | Example of the invention |
| C22 | 0 | 18 | 78 | Upper bainite | 876 | 78 | Comparative example |
| C23 | 6 | 18 | 100 | — | 1059 | 90 | Example of the invention |
| D21 | 5 | 18 | 100 | — | 1050 | 86 | Example of the invention |
| E21 | 6 | 18 | 100 | — | 1089 | 89 | Example of the invention |
| F21 | 6 | 18 | 100 | — | 1135 | 90 | Example of the invention |
| G21 | 6 | 18 | 100 | — | 1018 | 87 | Example of the invention |
| H21 | 7 | 18 | 100 | — | 1072 | 85 | Example of the invention |
| I21 | 6 | 18 | 100 | — | 1069 | 86 | Example of the invention |
| J21 | 5 | 18 | 100 | — | 1097 | 93 | Example of the invention |
| K21 | 6 | 18 | 100 | — | 1058 | 89 | Example of the invention |
| L21 | 6 | 18 | 100 | — | 1054 | 88 | Example of the invention |

TABLE 4C-continued

| Steel No. | Number density of iron carbides having major axis of 0.1 μm or more (number of items/μm³) | Cooling rate during hot stamping (° C./s) | Microstructure of hot stamped component (formed body) Tempered martensite (area %) | Structure of remainder | TS of formed body (MPa) | VDA bending angle of formed body (°) | Remarks |
|---|---|---|---|---|---|---|---|
| M21 | 7 | 18 | 100 | — | 1100 | 84 | Example of the invention |
| N21 | 6 | 18 | 100 | — | 1107 | 87 | Example of the invention |
| a21 | 2 | 18 | 75 | Upper bainite | 856 | 101 | Comparative example |
| b21 | 6 | 18 | 49 | Fresh martensite | 1509 | 60 | Comparative example |
| c21 | 1 | 18 | 69 | Upper bainite, Residual austenite | 1007 | 65 | Comparative example |
| d21 | 2 | 18 | 59 | Ferrite, Upper bainite | 819 | 82 | Comparative example |
| e21 | 3 | 18 | 76 | Fresh martensite | 1087 | 71 | Comparative example |
| f21 | 2 | 18 | 82 | Ferrite, Upper bainite | 1052 | 64 | Comparative example |
| g21 | 2 | 18 | 80 | Upper bainite, Fresh martensite | 1093 | 68 | Comparative example |
| h21 | 0 | 18 | 26 | Ferrite, Upper bainite | 806 | 92 | Comparative example |
| i21 | 1 | 18 | 48 | Ferrite, Upper bainite | 878 | 85 | Comparative example |
| j21 | 2 | 18 | 20 | Ferrite, Upper bainite | 799 | 106 | Comparative example |
| k21 | 7 | 18 | 82 | Upper bainite | 1048 | 72 | Comparative example |
| l21 | 2 | 18 | 65 | Upper bainite | 834 | 75 | Comparative example |
| m21 | 3 | 18 | 71 | Upper bainite | 906 | 59 | Comparative example |

As can be seen from Tables 1 and 4A to 4C, in the example of the invention, the tensile strength (TS) was equal to or greater than 980 MPa, and the VDA maximum bending angle is equal to or greater than 80° after hot stamping.

In contrast, in a comparative example, at least one of the tensile strength (TS) or the VDA maximum bending angle after hot stamping was degraded.

What is claimed is:

1. A steel sheet for hot stamping comprising, as a chemical composition, by mass %:

C: 0.060% to 0.120%;
Si: 0% to 0.70%;
Mn: 1.60% to 3.00%;
P: 0.100% or less;
S: 0.0100% or less;
N: 0.0100% or less;
Al: 0.001% to 0.100%;
Ti: 0.005% to 0.050%;
B: 0.0005% to 0.0100%;
Nb: 0% to 0.100%;
V: 0% to 0.100%;
W: 0% to 0.100%;
Ni: 0% to 2.00%;
Cu: 0% to 2.00%;
Cr: 0% to 2.00%;
Mo: 0% to 2.00%;
Sn: 0% to 0.200%;
Ca: 0% to 0.0500%;
Mg: 0% to 0.0500%;
REM: 0% to 0.0500%; and
a remainder of Fe and impurities, wherein a microstructure includes 70% or more of upper bainite by area ratio, and a number density of iron carbides having a major axis of 0.1 μm or more included in the upper bainite is equal to or greater than 4/μm², and wherein a carbide included in the upper bainite has a needle shape, is present between laths of the upper bainite, and has a shape elongated in one direction.

2. The steel sheet for hot stamping according to claim 1, wherein the chemical composition contains, by mass %, one or more of:

Nb: 0.005% to 0.100%;
V: 0.005% to 0.100%;
W: 0.005% to 0.100%;
Ni: 0.01% to 2.00%;
Cu: 0.01% to 2.00%;
Cr: 0.01% to 2.00%;
Mo: 0.01% to 2.00%;
Sn: 0.005% to 0.200%;
Ca: 0.0003% to 0.0500%;
Mg: 0.0003% to 0.0500%; and
REM: 0.0003% to 0.0500%.

3. The steel sheet for hot stamping according to claim 1 or 2, wherein a tensile strength is less than 980 MPa.

4. The steel sheet for hot stamping according to claim 1 or 2, wherein the steel sheet for hot stamping has a plating layer on a surface thereof.

5. The steel sheet for hot stamping according to claim 4, wherein the plating layer is a hot-dip galvanized layer, a hot-dip galvannealed layer, an electrogalvanized layer, or an Al plating layer.

6. A method for manufacturing a steel sheet for hot stamping according to claim 1, the method comprising:

a heating process of heating a steel ingot or a slab having the chemical composition according to claim 1 to 1,150° C. to 1,300° C. directly or after cooling the steel ingot or the slab;

a hot rolling process of performing hot rolling on the steel ingot or the slab after the heating process such that a finishing temperature is equal to or higher than 850° C. to obtain a hot-rolled steel sheet;

a coiling process of coiling the hot-rolled steel sheet after the hot rolling process at 640° C. to 450° C.;

a holding process of holding the hot-rolled steel sheet after the coiling process in a temperature range of 500° C. to 450° C. for 1.0 hour or longer; and a cooling process of cooling the hot-rolled steel sheet after the holding process to room temperature.

7. The method for manufacturing a steel sheet for hot stamping according to claim 6, further comprising:

a cold rolling process of performing cold rolling on the hot-rolled steel sheet after the holding process at a cumulative rolling reduction of 30% to 70% to obtain a cold-rolled steel sheet.

8. A method for manufacturing a steel sheet for hot stamping according to claim 1, the method comprising:

a heating process of heating a steel ingot or a slab having the chemical composition according to claim 1 to 1,150° C. to 1,300° C. directly or after cooling the steel ingot or the slab;

a hot rolling process of performing hot rolling on the steel ingot or the slab after the heating process such that a finishing temperature is equal to or higher than 850° C. to obtain a hot-rolled steel sheet;

a coiling process of coiling the hot-rolled steel sheet after the hot rolling process at 700° C. to 500° C.;

a cooling process of cooling the hot-rolled steel sheet after the coiling process to room temperature;

a pickling process of pickling the hot-rolled steel sheet after the cooling process;

a cold rolling process of performing cold rolling on the hot-rolled steel sheet after the pickling process at a cumulative rolling reduction of 30% to 70% to obtain a cold-rolled steel sheet;

an annealing process of heating the cold-rolled steel sheet to an annealing temperature range of 850° C. to 900° C. and holding the cold-rolled steel sheet in the annealing temperature range for 10 to 2,000 seconds; and a heat treatment process of cooling the cold-rolled steel sheet after the annealing process to a temperature range of 400° C. to 600° C., holding the cold-rolled steel sheet in the temperature range for 100 to 1,000 seconds, and cooling the cold-rolled steel sheet to room temperature.

9. The method for manufacturing a steel sheet for hot stamping according to claim 8, further comprising:

a plating process of immersing the cold-rolled steel sheet after the heat treatment process in a plating bath to form a plating layer on a surface of the cold-rolled steel sheet.

10. The method for manufacturing a steel sheet for hot stamping according to claim 9, further comprising:

an alloying process of holding the cold-rolled steel sheet after the plating process in an alloying temperature range of 450° C. to 600° C. to alloy the plating layer.

11. The method for manufacturing a steel sheet for hot stamping according to claim 8, further comprising:

a plating process of immersing the cold-rolled steel sheet after the annealing process and before the heat treatment process in a plating bath to form a plating layer on a surface of the cold-rolled steel sheet.

12. The method for manufacturing a steel sheet for hot stamping according to claim 11, further comprising:

an alloying process of holding the cold-rolled steel sheet after the plating process and before the heat treatment process in an alloying temperature range of 450° C. to 600° C. to alloy the plating layer.

13. A method for manufacturing a hot stamped component, the method comprising:

a hot stamping process of heating the steel sheet for hot stamping according to claim 1 using a heating furnace at an ambient temperature of 850° C. to 950° C. for 3 minutes or longer and cooling the steel sheet for hot stamping to a martensitic transformation start temperature or lower at a cooling rate of 10° C./sec or faster.

14. The method for manufacturing a hot stamped component according to claim 13, wherein the cooling rate in the hot stamping process is 10 to 20° C./sec.

15. A method for manufacturing a hot stamped component, the method comprising:

a hot stamping process of heating the steel sheet for hot stamping according to claim 2 using a heating furnace at an ambient temperature of 850° C. to 950° C. for 3 minutes or longer and cooling the steel sheet for hot stamping to a martensitic transformation start temperature or lower at a cooling rate of 10° C./sec or faster.

16. A method for manufacturing a hot stamped component, the method comprising:

a hot stamping process of heating the steel sheet for hot stamping according to claim 3 using a heating furnace at an ambient temperature of 850° C. to 950° C. for 3 minutes or longer and cooling the steel sheet for hot stamping to a martensitic transformation start temperature or lower at a cooling rate of 10° C./sec or faster.

17. A method for manufacturing a hot stamped component, the method comprising:

a hot stamping process of heating the steel sheet for hot stamping according to claim 4 using a heating furnace at an ambient temperature of 850° C. to 950° C. for 3 minutes or longer and cooling the steel sheet for hot stamping to a martensitic transformation start temperature or lower at a cooling rate of 10° C./sec or faster.

18. A method for manufacturing a hot stamped component, the method comprising:

a hot stamping process of heating the steel sheet for hot stamping according to claim 5 using a heating furnace at an ambient temperature of 850° C. to 950° C. for 3 minutes or longer and cooling the steel sheet for hot stamping to a martensitic transformation start temperature or lower at a cooling rate of 10° C./sec or faster.

* * * * *